US010421658B2

(12) United States Patent
Thompson

(10) Patent No.: US 10,421,658 B2
(45) Date of Patent: Sep. 24, 2019

(54) CONTAINER WITH ELECTRONICALLY CONTROLLED INTERLOCK

(71) Applicant: Proteus Digital Health, Inc., Redwood City, CA (US)

(72) Inventor: Andrew Thompson, Portola Valley, CA (US)

(73) Assignee: Proteus Digital Health, Inc., Redwood City, CA (US)

( * ) Notice: Subject to any disclaimer, the term of this patent is extended or adjusted under 35 U.S.C. 154(b) by 0 days.

(21) Appl. No.: 15/713,027

(22) Filed: Sep. 22, 2017

(65) Prior Publication Data

US 2018/0229996 A1 Aug. 16, 2018

Related U.S. Application Data

(63) Continuation of application No. 14/469,381, filed on Aug. 26, 2014, now Pat. No. 9,796,576.

(60) Provisional application No. 61/872,454, filed on Aug. 30, 2013.

(51) Int. Cl.

| | |
|---|---|
| ***B67D 7/34*** | (2010.01) |
| ***B65D 55/14*** | (2006.01) |
| ***B65D 49/00*** | (2006.01) |
| *B67D 3/00* | (2006.01) |

(52) U.S. Cl.

CPC ..... *B67D 7/34* (2013.01); *B65D 49/00* (2013.01); *B65D 55/14* (2013.01); *B67D 3/0061* (2013.01)

(58) Field of Classification Search

CPC . B67D 7/32; B67D 7/34; B67D 7/344; B67D 7/348; B67D 39/0061; B65D 55/14; B65D 49/00

See application file for complete search history.

(56) References Cited

U.S. PATENT DOCUMENTS

| | | | |
|---|---|---|---|
| 1,548,459 | A | 8/1925 | Hammer |
| 2,587,158 | A | 2/1952 | Hofberg |
| 2,973,555 | A | 3/1961 | Schwepke |
| 3,048,526 | A | 8/1962 | Boswell |
| 3,079,824 | A | 3/1963 | Schott |
| 3,096,248 | A | 7/1963 | Rudzki |
| 3,176,399 | A | 4/1965 | Marino et al. |
| 3,589,943 | A | 6/1971 | Grubb et al. |

(Continued)

FOREIGN PATENT DOCUMENTS

| | | |
|---|---|---|
| CN | 1588649 | 3/2005 |
| CN | 1650844 | 8/2005 |

(Continued)

OTHER PUBLICATIONS

AADE, "AADE 37th Annual Meeting San Antonio Aug. 4-7, 2010" American Association of Diabetes Educators (2010); http://www.diabeteseducator.org/annualmeeting/2010/index.html; 2 pp.

(Continued)

*Primary Examiner* — Jason K Niesz

(74) *Attorney, Agent, or Firm* — K&L Gates LLP

(57) ABSTRACT

The apparatus and methods of the current invention utilize a container having an interlock that prevents filling the container, dispensing from the container, or both, as well as a detecting mechanism that senses a unique identifier associated with a particular product allowing its use in conjunction with the container.

20 Claims, 15 Drawing Sheets

(56) References Cited

U.S. PATENT DOCUMENTS 3,607,788 A 9/1971 Adolph
3,642,008 A 2/1972 Bolduc
3,679,480 A 7/1972 Brown et al.
3,682,160 A 8/1972 Murata
3,719,183 A 3/1973 Schwartz
3,799,802 A 3/1974 Schneble, Jr. et al.
3,828,766 A 8/1974 Krasnow
3,837,339 A 9/1974 Aisenberg et al.
3,849,041 A 11/1974 Knapp
3,893,111 A 7/1975 Cotter
3,944,064 A 3/1976 Bashaw et al.
3,967,202 A 6/1976 Batz
3,989,050 A 11/1976 Buchalter
4,017,856 A 4/1977 Wiegand
4,055,178 A 10/1977 Harrigan
4,062,750 A 12/1977 Butler
4,077,397 A 3/1978 Ellis
4,077,398 A 3/1978 Ellis
4,082,087 A 4/1978 Howson
4,090,752 A 5/1978 Long
4,106,348 A 8/1978 Auphan
4,129,125 A 12/1978 Lester
4,139,589 A 2/1979 Beringer et al.
4,143,770 A 3/1979 Grimmell et al.
4,166,453 A 9/1979 McClelland
4,239,046 A 12/1980 Ong
4,251,795 A 2/1981 Shibasaki et al.
4,269,189 A 5/1981 Abraham
4,331,654 A 5/1982 Morris
4,345,588 A 8/1982 Widder et al.
4,418,697 A 12/1983 Tama
4,425,117 A 1/1984 Hugemann
4,439,196 A 3/1984 Higuchi
4,494,950 A 1/1985 Fischell
4,559,950 A 12/1985 Vaughan
4,564,363 A 1/1986 Bagnall et al.
4,635,641 A 1/1987 Hoffman
4,654,165 A 3/1987 Eisenber
4,663,250 A 5/1987 Ong et al.
4,669,479 A 6/1987 Dunseath
4,687,660 A 8/1987 Baker et al.
4,725,997 A 2/1988 Urquhart et al.
4,749,575 A 6/1988 Rotman et al.
4,763,659 A 8/1988 Dunseath
4,767,627 A 8/1988 Caldwell et al.
4,775,536 A 10/1988 Patell
4,784,162 A 11/1988 Ricks
4,793,825 A 12/1988 Benjamin et al.
4,814,181 A 3/1989 Jordan et al.
4,844,076 A 7/1989 Lesho
4,847,090 A 7/1989 Della Posta et al.
4,876,093 A 10/1989 Theeuwes et al.
4,891,223 A 1/1990 Ambegaonakar et al.
4,896,261 A 1/1990 Nolan
4,900,552 A 2/1990 Sanvordeker et al.
4,975,230 A 12/1990 Pinkhasov
4,987,897 A 1/1991 Funke
5,000,957 A 3/1991 Eckenhoff et al.
5,016,634 A 5/1991 Vock et al.
5,018,335 A 5/1991 Yamamoto et al.
5,079,006 A 1/1992 Urguhart
5,110,441 A 5/1992 Kinlen et al.
5,160,885 A 11/1992 Hannam et al.
5,167,626 A 12/1992 Casper
5,176,626 A 1/1993 Soehendra
5,187,723 A 2/1993 Mueller
5,213,738 A 5/1993 Hampton et al.
5,218,343 A 6/1993 Stobbe et al.
5,261,402 A 11/1993 DiSabito
5,263,481 A 11/1993 Axelgaard et al.
5,273,066 A 12/1993 Graham et al.
5,279,607 A 1/1994 Schentag et al.
5,281,287 A 1/1994 Lloyd
5,283,136 A 2/1994 Peled et al.
5,288,564 A 2/1994 Klein
5,305,745 A 4/1994 Zacouto
5,310,301 A 5/1994 Aono
5,318,557 A 6/1994 Gross
5,331,953 A 7/1994 Andersson et al.
5,394,882 A 3/1995 Mawhinney
5,395,366 A 3/1995 D'Andrea et al.
5,436,091 A 7/1995 Shackle et al.
5,443,461 A 8/1995 Atkinson et al.
5,443,843 A 8/1995 Curatolo et al.
5,458,141 A 10/1995 Neil et al.
5,458,994 A 10/1995 Nesselbeck et al.
5,485,841 A 1/1996 Watkin et al.
5,506,248 A 4/1996 Nikfar et al.
5,551,020 A 8/1996 Flax et al.
5,567,210 A 10/1996 Bates et al.
5,596,302 A 1/1997 Mastrocola et al.
5,600,548 A 2/1997 Nguyen et al.
5,603,363 A 2/1997 Nelson
5,634,468 A 6/1997 Platt
5,645,063 A 7/1997 Straka et al.
5,659,247 A 8/1997 Clements
5,703,463 A 12/1997 Smith
5,705,189 A 1/1998 Lehmann et al.
5,724,432 A 3/1998 Bouvet et al.
5,738,708 A 4/1998 Peachey et al.
5,740,811 A 4/1998 Hedberg
5,757,326 A 5/1998 Koyama et al.
5,772,575 A 6/1998 Lesinski et al.
5,792,048 A 8/1998 Schaefer
5,802,467 A 9/1998 Salazar
5,833,716 A 11/1998 Bar-Or
5,842,324 A 12/1998 Grosskopf et al.
5,845,265 A 12/1998 Woolston
5,862,803 A 1/1999 Besson
5,868,136 A 2/1999 Fox
5,914,132 A 6/1999 Kelm et al.
5,914,701 A 6/1999 Gersheneld et al.
5,925,030 A 7/1999 Gross et al.
5,957,854 A 9/1999 Besson et al.
5,963,132 A 10/1999 Yoakum et al.
5,974,124 A 10/1999 Schlueter, Jr. et al.
5,981,166 A 11/1999 Mandecki
5,999,846 A 12/1999 Pardey et al.
6,018,229 A 1/2000 Mitchell et al.
6,038,464 A 3/2000 Axelgaard et al.
6,042,710 A 3/2000 Dubrow
6,047,203 A 4/2000 Sackner
6,068,465 A 5/2000 Wilson
6,068,589 A 5/2000 Neukermans
6,076,016 A 6/2000 Feierbach et al.
6,081,734 A 6/2000 Batz
6,091,975 A 7/2000 Daddona et al.
6,095,985 A 8/2000 Raymond et al.
6,115,636 A 9/2000 Ryan
6,122,351 A 9/2000 Schlueter, Jr. et al.
6,141,592 A 10/2000 Pauly
6,149,940 A 11/2000 Maggi et al.
6,200,265 B1 3/2001 Walsh et al.
6,206,702 B1 3/2001 Hayden et al.
6,217,744 B1 4/2001 Crosby
6,231,593 B1 5/2001 Meserol
6,245,057 B1 6/2001 Sieben et al.
6,269,058 B1 7/2001 Yamanoi et al.
6,285,897 B1 9/2001 Kilcoyne et al.
6,287,252 B1 9/2001 Lugo
6,288,629 B1 9/2001 Cofino et al.
6,289,238 B1 9/2001 Besson et al.
6,315,719 B1 11/2001 Rode et al.
6,317,714 B1 11/2001 Del Castillo
6,342,774 B1 1/2002 Kreisinger et al.
6,344,824 B1 2/2002 Takasugi et al.
6,358,202 B1 3/2002 Arent
6,364,834 B1 4/2002 Reuss
6,366,206 B1 4/2002 Ishikawa et al.
6,371,927 B1 4/2002 Brune
6,374,670 B1 4/2002 Spelman
6,380,858 B1 4/2002 Yarin et al.
6,390,088 B1 5/2002 Noehl et al.
6,394,997 B1 5/2002 Lemelson

(56) References Cited

U.S. PATENT DOCUMENTS 6,426,863 B1 7/2002 Munshi
6,432,292 B1 8/2002 Pinto et al.
6,440,069 B1 8/2002 Raymond et al.
6,441,747 B1 8/2002 Khair
6,453,199 B1 9/2002 Kobozev
6,477,424 B1 11/2002 Thompson et al.
6,496,705 B1 12/2002 Ng et al.
6,526,315 B1 2/2003 Inagawa
6,531,026 B1 3/2003 Takeichi et al.
6,544,174 B2 4/2003 West
6,547,994 B1 4/2003 Monkhouse et al.
6,564,079 B1 5/2003 Cory
6,567,685 B2 5/2003 Takamori et al.
6,572,636 B1 6/2003 Hagen et al.
6,577,893 B1 6/2003 Besson
6,579,231 B1 6/2003 Phipps
6,595,929 B2 7/2003 Stivoric
6,599,284 B2 7/2003 Faour et al.
6,602,518 B2 8/2003 Seielstad et al.
6,605,038 B1 8/2003 Teller
6,609,018 B2 8/2003 Cory
6,612,984 B1 9/2003 Kerr
6,632,175 B1 10/2003 Marshall
6,632,216 B2 10/2003 Houzego et al.
6,635,279 B2 10/2003 Kolter et al.
6,643,541 B2 11/2003 Mok et al.
6,654,638 B1 11/2003 Sweeney
6,663,846 B1 12/2003 McCombs
6,673,474 B2 1/2004 Yamamoto
6,680,923 B1 1/2004 Leon
6,689,117 B2 2/2004 Sweeney et al.
6,694,161 B2 2/2004 Mehrotra
6,704,602 B2 3/2004 Berg et al.
6,720,923 B1 4/2004 Hayward et al.
6,738,671 B2 5/2004 Christophersom et al.
6,740,033 B1 5/2004 Olejniczak et al.
6,745,082 B2 6/2004 Axelgaard et al.
6,755,783 B2 6/2004 Cosentino
6,757,523 B2 6/2004 Fry
6,759,968 B2 7/2004 Zierolf
6,767,200 B2 7/2004 Sowden et al.
6,773,429 B2 8/2004 Sheppard et al.
6,800,060 B2 10/2004 Marshall
6,801,137 B2 10/2004 Eggers et al.
6,816,794 B2 11/2004 Alvi
6,822,554 B2 11/2004 Vrijens et al.
6,824,512 B2 11/2004 Warkentin et al.
6,836,862 B1 12/2004 Erekson et al.
6,839,659 B2 1/2005 Tarassenko et al.
6,840,904 B2 1/2005 Goldberg
6,842,636 B2 1/2005 Perrault
6,845,272 B1 1/2005 Thomsen
6,864,780 B2 3/2005 Doi
6,879,810 B2 4/2005 Bouet
6,888,337 B2 5/2005 Sawyers
6,889,165 B2 5/2005 Lind et al.
6,909,878 B2 6/2005 Haller
6,922,592 B2 7/2005 Thompson et al.
6,928,370 B2 8/2005 Anuzis et al.
6,929,636 B1 8/2005 Von Alten
6,937,150 B2 8/2005 Medema
6,942,616 B2 9/2005 Kerr
6,942,770 B2 9/2005 Cai et al.
6,946,156 B2 9/2005 Bunick
6,951,536 B2 10/2005 Yokoi
6,957,107 B2 10/2005 Rogers et al.
6,958,603 B2 10/2005 Kondo
6,960,617 B2 11/2005 Omidian et al.
6,968,153 B1 11/2005 Heinonen
6,977,511 B2 12/2005 Patel et al.
6,982,094 B2 1/2006 Sowden
6,987,965 B2 1/2006 Ng et al.
6,990,082 B1 1/2006 Zehavi et al.
7,002,476 B2 2/2006 Rapchak
7,004,395 B2 2/2006 Koenck
7,009,634 B2 3/2006 Iddan et al.
7,009,946 B1 3/2006 Kardach
7,013,162 B2 3/2006 Gorsuch
7,016,648 B2 3/2006 Haller
7,020,508 B2 3/2006 Stivoric
7,024,248 B2 4/2006 Penner et al.
7,031,745 B2 4/2006 Shen
7,031,857 B2 4/2006 Tarassenko et al.
7,039,453 B2 5/2006 Mullick
7,044,911 B2 5/2006 Drinan et al.
7,046,649 B2 5/2006 Awater et al.
7,061,236 B2 6/2006 Britton
7,083,578 B2 8/2006 Lewkowicz
7,116,252 B2 10/2006 Teraguchi
7,118,531 B2 10/2006 Krill
7,122,143 B2 10/2006 Sowden et al.
7,127,300 B2 10/2006 Mazar et al.
7,146,228 B2 12/2006 Nielsen
7,146,449 B2 12/2006 Do et al.
7,149,581 B2 12/2006 Goedeke et al.
7,154,071 B2 12/2006 Sattler et al.
7,155,232 B2 12/2006 Godfrey et al.
7,160,258 B2 1/2007 Imran
7,164,942 B2 1/2007 Avrahami
7,171,166 B2 1/2007 Ng et al.
7,171,177 B2 1/2007 Park et al.
7,171,259 B2 1/2007 Rytky
7,176,784 B2 2/2007 Gilbert et al.
7,187,960 B2 3/2007 Abreu
7,188,199 B2 3/2007 Leung et al.
7,188,767 B2 3/2007 Penuela
7,194,038 B1 3/2007 Inkinen
7,196,495 B1 3/2007 Burcham
7,206,630 B1 4/2007 Tarler
7,209,790 B2 4/2007 Thompson et al.
7,215,660 B2 5/2007 Perlman
7,215,991 B2 5/2007 Besson
7,218,967 B2 5/2007 Bergelson
7,231,451 B2 6/2007 Law
7,243,118 B2 7/2007 Lou
7,246,521 B2 7/2007 Kim
7,249,212 B2 7/2007 Do
7,252,792 B2 8/2007 Perrault
7,253,716 B2 8/2007 Lovoi et al.
7,261,690 B2 8/2007 Teller
7,270,633 B1 9/2007 Goscha
7,273,454 B2 9/2007 Raymond et al.
7,289,855 B2 10/2007 Nghiem
7,291,497 B2 11/2007 Holmes
7,292,139 B2 11/2007 Mazar et al.
7,294,105 B1 11/2007 Islam
7,311,665 B2 12/2007 Hawthorne
7,313,163 B2 12/2007 Liu
7,317,378 B2 1/2008 Jarvis et al.
7,318,808 B2 1/2008 Tarassenko et al.
7,336,929 B2 2/2008 Yasuda
7,342,895 B2 3/2008 Serpa
7,346,380 B2 3/2008 Axelgaard et al.
7,349,722 B2 3/2008 Witkowski et al.
7,352,998 B2 4/2008 Palin
7,353,258 B2 4/2008 Washburn
7,357,891 B2 4/2008 Yang et al.
7,359,674 B2 4/2008 Markki
7,366,558 B2 4/2008 Virtanen et al.
7,368,190 B2 5/2008 Heller et al.
7,368,191 B2 5/2008 Andelman et al.
7,373,196 B2 5/2008 Ryu et al.
7,375,739 B2 5/2008 Robbins
7,376,435 B2 5/2008 McGowan
7,382,247 B2 6/2008 Welch et al.
7,382,263 B2 6/2008 Danowski et al.
7,387,607 B2 6/2008 Holt
7,388,903 B2 6/2008 Godfrey et al.
7,389,088 B2 6/2008 Kim
7,392,015 B1 6/2008 Farlow
7,395,106 B2 7/2008 Ryu et al.
7,396,330 B2 7/2008 Banet
7,404,968 B2 7/2008 Abrams et al.
7,413,544 B2 8/2008 Kerr

(56) References Cited

U.S. PATENT DOCUMENTS

| | | | |
|---|---|---|---|
| 7,414,534 | B1 | 8/2008 | Kroll et al. |
| 7,414,543 | B2 | 8/2008 | Rye et al. |
| 7,415,242 | B1 | 8/2008 | Ngan |
| 7,424,268 | B2 | 9/2008 | Diener |
| 7,424,319 | B2 | 9/2008 | Muehlsteff |
| 7,427,266 | B2 | 9/2008 | Ayer et al. |
| 7,442,164 | B2 | 10/2008 | Berrang et al. |
| 7,443,290 | B2 | 10/2008 | Takiguchi |
| 7,458,887 | B2 | 12/2008 | Kurosawa |
| 7,469,838 | B2 | 12/2008 | Brooks et al. |
| 7,471,665 | B2 | 12/2008 | Perlman |
| 7,471,992 | B2 | 12/2008 | Schmidt et al. |
| 7,492,128 | B2 | 2/2009 | Shen |
| 7,499,674 | B2 | 3/2009 | Salokannel |
| 7,510,121 | B2 | 3/2009 | Koenck |
| 7,512,448 | B2 | 3/2009 | Malick |
| 7,515,043 | B2 | 4/2009 | Welch |
| 7,519,416 | B2 | 4/2009 | Sula et al. |
| 7,523,756 | B2 | 4/2009 | Minai |
| 7,525,426 | B2 | 4/2009 | Edelstein |
| 7,527,807 | B2 | 5/2009 | Choi et al. |
| 7,537,590 | B2 | 5/2009 | Santini, Jr. et al. |
| 7,539,533 | B2 | 5/2009 | Tran |
| 7,542,878 | B2 | 6/2009 | Nanikashvili |
| 7,547,278 | B2 | 6/2009 | Miyazaki et al. |
| 7,551,590 | B2 | 6/2009 | Haller |
| 7,554,452 | B2 | 6/2009 | Cole |
| 7,558,620 | B2 | 7/2009 | Ishibashi |
| 7,575,005 | B2 | 8/2009 | Mumford |
| 7,616,111 | B2 | 11/2009 | Covannon |
| 7,617,001 | B2 | 11/2009 | Penner et al. |
| 7,626,387 | B2 | 12/2009 | Adachi |
| 7,639,473 | B2 | 12/2009 | Hsu et al. |
| 7,640,802 | B2 | 1/2010 | King et al. |
| 7,645,262 | B2 | 1/2010 | Greenberg et al. |
| 7,647,112 | B2 | 1/2010 | Tracey |
| 7,647,185 | B2 | 1/2010 | Tarassenko et al. |
| 7,653,031 | B2 | 1/2010 | Godfrey et al. |
| 7,672,714 | B2 | 3/2010 | Kuo |
| 7,673,679 | B2 | 3/2010 | Harrison et al. |
| 7,678,043 | B2 | 3/2010 | Gilad |
| 7,686,839 | B2 | 3/2010 | Parker |
| 7,697,994 | B2 | 4/2010 | VanDanacker et al. |
| 7,720,036 | B2 | 5/2010 | Sadri |
| 7,729,776 | B2 | 6/2010 | Von Arx et al. |
| 7,733,224 | B2 | 6/2010 | Tran |
| 7,736,318 | B2 | 6/2010 | Costentino |
| 7,756,587 | B2 | 7/2010 | Penner et al. |
| 7,760,104 | B2 | 7/2010 | Asp |
| 7,782,991 | B2 | 8/2010 | Sobchak et al. |
| 7,796,043 | B2 | 9/2010 | Euliano et al. |
| 7,797,033 | B2 | 9/2010 | D'Andrea et al. |
| 7,809,399 | B2 | 10/2010 | Lu |
| 7,844,341 | B2 | 11/2010 | Von Arx et al. |
| 7,881,799 | B2 | 2/2011 | Greenberg et al. |
| 7,975,587 | B2 | 7/2011 | Schneider |
| 7,978,064 | B2 | 7/2011 | Zdeblick et al. |
| 7,983,189 | B2 | 7/2011 | Bugenhagen |
| 8,036,731 | B2 | 10/2011 | Kimchy et al. |
| 8,036,748 | B2 | 10/2011 | Zdeblick et al. |
| 8,054,047 | B2 | 11/2011 | Chen et al. |
| 8,054,140 | B2 | 11/2011 | Fleming et al. |
| 8,055,334 | B2 | 11/2011 | Savage et al. |
| 8,082,919 | B2 | 12/2011 | Brunnberg et al. |
| 8,119,045 | B2 | 2/2012 | Schmidt et al. |
| 8,131,376 | B1 | 3/2012 | Faraji et al. |
| 8,177,611 | B2 | 5/2012 | Kang |
| 8,185,191 | B1 | 5/2012 | Shapiro et al. |
| 8,185,646 | B2 | 5/2012 | Headley |
| 8,200,320 | B2 | 6/2012 | Kovacs |
| 8,207,731 | B2 | 6/2012 | Moskalenko |
| 8,224,596 | B2 | 7/2012 | Agrawal et al. |
| 8,253,586 | B1 | 8/2012 | Matak |
| 8,254,853 | B2 | 8/2012 | Rofougaran |
| 8,271,146 | B2 | 9/2012 | Heber et al. |
| 8,298,574 | B2 | 10/2012 | Tsabari et al. |
| 8,343,068 | B2 | 1/2013 | Najafi et al. |
| 8,374,698 | B2 | 2/2013 | Ok et al. |
| 8,389,003 | B2 | 3/2013 | Mintchev et al. |
| 8,404,275 | B2 | 3/2013 | Habboushe |
| 8,425,492 | B2 | 4/2013 | Herbert et al. |
| 8,443,214 | B2 | 5/2013 | Lee et al. |
| 8,454,528 | B2 | 6/2013 | Yuen et al. |
| 8,532,776 | B2 | 9/2013 | Greenberg et al. |
| 8,540,633 | B2 | 9/2013 | Hafezi et al. |
| 8,540,664 | B2 | 9/2013 | Robertson et al. |
| 8,545,402 | B2 | 10/2013 | Hafezi et al. |
| 8,547,248 | B2 | 10/2013 | Zdeblick et al. |
| 8,558,563 | B2 | 10/2013 | Zdeblick |
| 8,564,432 | B2 | 10/2013 | Covannon et al. |
| 8,597,186 | B2 | 12/2013 | Hafezi et al. |
| 8,634,838 | B2 | 1/2014 | Hellwig et al. |
| 8,647,358 | B2 | 2/2014 | Brister et al. |
| 8,660,645 | B2 | 2/2014 | Stevenson et al. |
| 8,668,643 | B2 | 3/2014 | Kinast |
| 8,685,451 | B2 | 4/2014 | Toneguzzo et al. |
| 8,697,057 | B2 | 4/2014 | Van Epps et al. |
| 8,698,006 | B2 | 4/2014 | Bealka et al. |
| 8,721,540 | B2 | 5/2014 | Hafezi et al. |
| 8,758,237 | B2 | 6/2014 | Sherman et al. |
| 8,784,308 | B2 | 7/2014 | Duck et al. |
| 8,802,183 | B2 | 8/2014 | Frank et al. |
| 8,816,847 | B2 | 8/2014 | Zdeblick et al. |
| 8,836,513 | B2 | 9/2014 | Hafezi et al. |
| 8,838,217 | B2 | 9/2014 | Myr |
| 8,858,432 | B2 | 10/2014 | Robertson |
| 8,908,943 | B2 | 12/2014 | Berry et al. |
| 8,912,908 | B2 | 12/2014 | Berkman et al. |
| 8,926,509 | B2 | 1/2015 | Magar et al. |
| 8,932,221 | B2 | 1/2015 | Colliou et al. |
| 8,945,005 | B2 | 2/2015 | Hafezi et al. |
| 8,951,234 | B2 | 2/2015 | Hafezi et al. |
| 8,989,837 | B2 | 3/2015 | Weinstein et al. |
| 9,031,658 | B2 | 5/2015 | Chiao et al. |
| 9,088,168 | B2 | 7/2015 | Mach et al. |
| 9,107,806 | B2 | 8/2015 | Hafezi et al. |
| 9,119,554 | B2 | 9/2015 | Robertson et al. |
| 9,119,918 | B2 | 9/2015 | Robertson et al. |
| 9,149,423 | B2 | 10/2015 | Duck et al. |
| 9,158,890 | B2 | 10/2015 | Meredith et al. |
| 9,161,707 | B2 | 10/2015 | Hafezi et al. |
| 9,189,941 | B2 | 11/2015 | Eschelman et al. |
| 9,226,663 | B2 | 1/2016 | Fei |
| 9,226,679 | B2 | 1/2016 | Balda |
| 9,268,909 | B2 | 2/2016 | Jani et al. |
| 9,270,025 | B2 | 2/2016 | Robertson et al. |
| 9,271,897 | B2 | 3/2016 | Costello et al. |
| 9,277,864 | B2 | 3/2016 | Yang et al. |
| 9,320,455 | B2 | 4/2016 | Hafezi et al. |
| 9,415,010 | B2 | 8/2016 | Hafezi et al. |
| 9,433,371 | B2 | 9/2016 | Hafezi et al. |
| 9,439,582 | B2 | 9/2016 | Berkman et al. |
| 9,439,599 | B2 | 9/2016 | Thompson et al. |
| 9,517,012 | B2 | 12/2016 | Lane et al. |
| 9,597,010 | B2 | 3/2017 | Thompson et al. |
| 9,597,487 | B2 | 3/2017 | Robertson et al. |
| 9,599,679 | B2 | 3/2017 | Taylor et al. |
| 9,649,066 | B2 | 5/2017 | Zdeblick et al. |
| 9,681,842 | B2 | 6/2017 | Zdeblick et al. |
| 9,741,975 | B2 | 8/2017 | Laulicht et al. |
| 9,756,874 | B2 | 9/2017 | Arne et al. |
| 9,962,107 | B2 | 5/2018 | Frank et al. |
| 9,968,284 | B2 | 5/2018 | Vidalis et al. |
| 2001/0027331 | A1 | 10/2001 | Thompson |
| 2001/0044588 | A1 | 11/2001 | Mault |
| 2001/0051766 | A1 | 12/2001 | Gazdinski |
| 2002/0002326 | A1 | 1/2002 | Causey et al. |
| 2002/0026111 | A1 | 2/2002 | Ackerman |
| 2002/0032384 | A1 | 3/2002 | Raymond et al. |
| 2002/0032385 | A1 | 3/2002 | Raymond et al. |
| 2002/0040278 | A1 | 4/2002 | Anuzis et al. |
| 2002/0077620 | A1 | 6/2002 | Sweeney et al. |
| 2002/0128934 | A1 | 9/2002 | Shaer |
| 2002/0132226 | A1 | 9/2002 | Nair |

(56) References Cited

U.S. PATENT DOCUMENTS

2002/0136744 A1 9/2002 McGlynn et al.
2002/0179921 A1 12/2002 Cohn
2002/0192159 A1 12/2002 Reitberg
2002/0193669 A1 12/2002 Glukhovsky
2002/0198470 A1 12/2002 Imran et al.
2003/0017826 A1 1/2003 Fishman et al.
2003/0023150 A1 1/2003 Yokoi et al.
2003/0028226 A1 2/2003 Thompson
2003/0062551 A1 4/2003 Chen et al.
2003/0065536 A1 4/2003 Hansen
2003/0076179 A1 4/2003 Branch et al.
2003/0083559 A1 5/2003 Thompson
2003/0091625 A1 5/2003 Hariharan et al.
2003/0126593 A1 7/2003 Mault
2003/0130714 A1 7/2003 Nielsen et al.
2003/0135128 A1 7/2003 Suffin et al.
2003/0135392 A1 7/2003 Vrijens et al.
2003/0152622 A1 8/2003 Louie-Helm et al.
2003/0158466 A1 8/2003 Lynn et al.
2003/0158756 A1 8/2003 Abramson
2003/0162556 A1 8/2003 Libes
2003/0164401 A1 9/2003 Andreasson et al.
2003/0167000 A1 9/2003 Mullick et al.
2003/0171791 A1 9/2003 KenKnight
2003/0171898 A1 9/2003 Tarassenko et al.
2003/0181788 A1 9/2003 Yokoi et al.
2003/0185286 A1 10/2003 Yuen
2003/0187337 A1 10/2003 Tarassenko et al.
2003/0187338 A1 10/2003 Say et al.
2003/0195403 A1 10/2003 Berner et al.
2003/0213495 A1 11/2003 Fujita et al.
2003/0214579 A1 11/2003 Iddan
2003/0216622 A1 11/2003 Meron et al.
2003/0216625 A1 11/2003 Phipps
2003/0216666 A1 11/2003 Ericson et al.
2003/0216729 A1 11/2003 Marchitto
2003/0219484 A1 11/2003 Sowden et al.
2003/0232895 A1 12/2003 Omidian et al.
2004/0008123 A1 1/2004 Carrender et al.
2004/0018476 A1 1/2004 LaDue
2004/0034295 A1 2/2004 Salganicoff
2004/0049245 A1 3/2004 Gass
2004/0073095 A1 4/2004 Causey et al.
2004/0073454 A1 4/2004 Urquhart et al.
2004/0077995 A1 4/2004 Ferek-Petric
2004/0082982 A1 4/2004 Gord et al.
2004/0087839 A1 5/2004 Raymond et al.
2004/0092801 A1 5/2004 Drakulic
2004/0106859 A1 6/2004 Say et al.
2004/0115507 A1 6/2004 Potter et al.
2004/0115517 A1 6/2004 Fukada et al.
2004/0117062 A1 6/2004 Bonney et al.
2004/0121015 A1 6/2004 Chidlaw et al.
2004/0148140 A1 7/2004 Tarassenko et al.
2004/0153007 A1 8/2004 Harris
2004/0167226 A1 8/2004 Serafini
2004/0167465 A1 8/2004 Mihai et al.
2004/0167801 A1 8/2004 Say et al.
2004/0193020 A1 9/2004 Chiba
2004/0193029 A1 9/2004 Gluhovsky
2004/0193446 A1 9/2004 Mayer et al.
2004/0199222 A1 10/2004 Sun et al.
2004/0215084 A1 10/2004 Shimizu et al.
2004/0218683 A1 11/2004 Batra
2004/0220643 A1 11/2004 Schmidt
2004/0224644 A1 11/2004 Wu
2004/0225199 A1 11/2004 Evanyk
2004/0253304 A1 12/2004 Gross et al.
2004/0258571 A1 12/2004 Lee et al.
2004/0259899 A1 12/2004 Sanghvi et al.
2004/0260154 A1 12/2004 Sidelnik
2005/0003074 A1 1/2005 Brown et al.
2005/0017841 A1 1/2005 Doi
2005/0020887 A1 1/2005 Goldberg
2005/0021370 A1 1/2005 Riff
2005/0024198 A1 2/2005 Ward
2005/0027205 A1 2/2005 Tarassenko et al.
2005/0038321 A1 2/2005 Fujita et al.
2005/0043634 A1 2/2005 Yokoi et al.
2005/0043894 A1 2/2005 Fernandez
2005/0054897 A1 3/2005 Hashimoto et al.
2005/0055014 A1 3/2005 Coppeta et al.
2005/0062644 A1 3/2005 Leci
2005/0065407 A1 3/2005 Nakamura et al.
2005/0070778 A1 3/2005 Lackey
2005/0075145 A1 4/2005 Dvorak et al.
2005/0090753 A1 4/2005 Goor et al.
2005/0092108 A1 5/2005 Andermo
2005/0096514 A1 5/2005 Starkebaum
2005/0096562 A1 5/2005 Delalic et al.
2005/0101843 A1 5/2005 Quinn
2005/0101872 A1 5/2005 Sattler
2005/0115561 A1 6/2005 Stahmann et al.
2005/0116820 A1 6/2005 Goldreich
2005/0117389 A1 6/2005 Worledge
2005/0121322 A1 6/2005 Say et al.
2005/0131281 A1 6/2005 Ayer et al.
2005/0143623 A1 6/2005 Kojima
2005/0146594 A1 7/2005 Nakatani et al.
2005/0148883 A1 7/2005 Boesen
2005/0154428 A1 7/2005 Bruinsma
2005/0156709 A1 7/2005 Gilbert et al.
2005/0165323 A1 7/2005 Montgomery
2005/0177069 A1 8/2005 Takizawa
2005/0182389 A1 8/2005 LaPorte
2005/0187789 A1 8/2005 Hatlestad et al.
2005/0192489 A1 9/2005 Marshall
2005/0197680 A1 9/2005 DelMain et al.
2005/0208251 A1 9/2005 Aisenbrey
2005/0228268 A1 10/2005 Cole
2005/0234307 A1 10/2005 Heinonen
2005/0240305 A1 10/2005 Bogash et al.
2005/0245794 A1 11/2005 Dinsmoor
2005/0259768 A1 11/2005 Yang et al.
2005/0261559 A1 11/2005 Mumford
2005/0267556 A1 12/2005 Shuros et al.
2005/0267756 A1 12/2005 Schultz et al.
2005/0277912 A1 12/2005 John
2005/0277999 A1 12/2005 Strother et al.
2005/0279054 A1 12/2005 Mauze et al.
2005/0280539 A1 12/2005 Pettus
2005/0285746 A1 12/2005 Sengupta
2005/0288594 A1 12/2005 Lewkowicz et al.
2006/0001496 A1 1/2006 Abrosimov et al.
2006/0028727 A1 2/2006 Moon et al.
2006/0036134 A1 2/2006 Tarassenko et al.
2006/0058602 A1 3/2006 Kwiatkowski et al.
2006/0061472 A1 3/2006 Lovoi et al.
2006/0065713 A1 3/2006 Kingery
2006/0068006 A1 3/2006 Begleiter
2006/0074283 A1 4/2006 Henderson
2006/0074319 A1 4/2006 Barnes et al.
2006/0078765 A1 4/2006 Yang et al.
2006/0095091 A1 5/2006 Drew
2006/0095093 A1 5/2006 Bettesh et al.
2006/0100533 A1 5/2006 Han
2006/0109058 A1 5/2006 Keating
2006/0110962 A1 5/2006 Powell
2006/0122474 A1 6/2006 Teller et al.
2006/0122494 A1 6/2006 Bouchoucha
2006/0122667 A1 6/2006 Chavan et al.
2006/0129060 A1 6/2006 Lee et al.
2006/0136266 A1 6/2006 Tarassenko et al.
2006/0142648 A1 6/2006 Banet
2006/0145876 A1 7/2006 Kimura
2006/0148254 A1 7/2006 McLean
2006/0149339 A1 7/2006 Burnes
2006/0155174 A1 7/2006 Glukhovsky et al.
2006/0155183 A1 7/2006 Kroecker
2006/0161225 A1 7/2006 Sormann et al.
2006/0179949 A1 8/2006 Kim
2006/0183993 A1 8/2006 Horn
2006/0184092 A1 8/2006 Atanasoska et al.
2006/0204738 A1 9/2006 Dubrow et al.

(56) References Cited

U.S. PATENT DOCUMENTS

2006/0210626 A1 9/2006 Spaeder
2006/0216603 A1 9/2006 Choi
2006/0218011 A1 9/2006 Walker
2006/0235489 A1 10/2006 Drew
2006/0243288 A1 11/2006 Kim et al.
2006/0247505 A1 11/2006 Siddiqui
2006/0253005 A1 11/2006 Drinan
2006/0270346 A1 11/2006 Ibrahim
2006/0273882 A1 12/2006 Posamentier
2006/0276702 A1 12/2006 McGinnis
2006/0280227 A1 12/2006 Pinkney
2006/0282001 A1 12/2006 Noel
2006/0289640 A1 12/2006 Mercure
2006/0293607 A1 12/2006 Alt
2007/0000776 A1 1/2007 Karube et al.
2007/0002038 A1 1/2007 Suzuki
2007/0006636 A1 1/2007 King et al.
2007/0008113 A1 1/2007 Spoonhower et al.
2007/0016089 A1 1/2007 Fischell et al.
2007/0027386 A1 2/2007 Such
2007/0027388 A1 2/2007 Chou
2007/0029195 A1 2/2007 Li et al.
2007/0038054 A1 2/2007 Zhou
2007/0049339 A1 3/2007 Barak et al.
2007/0055098 A1 3/2007 Shimizu et al.
2007/0060797 A1 3/2007 Ball
2007/0060800 A1 3/2007 Drinan et al.
2007/0066929 A1 3/2007 Ferren et al.
2007/0073353 A1 3/2007 Rooney et al.
2007/0096765 A1 5/2007 Kagan
2007/0106346 A1 5/2007 Bergelson
2007/0123772 A1 5/2007 Euliano
2007/0129622 A1 6/2007 Bourget
2007/0130287 A1 6/2007 Kumar
2007/0135803 A1 6/2007 Belson
2007/0142721 A1 6/2007 Berner et al.
2007/0156016 A1 7/2007 Betesh
2007/0160789 A1 7/2007 Merical
2007/0162089 A1 7/2007 Mosesov
2007/0162090 A1 7/2007 Penner
2007/0167495 A1 7/2007 Brown et al.
2007/0167848 A1 7/2007 Kuo et al.
2007/0173701 A1 7/2007 Al-Ali
2007/0179347 A1 8/2007 Tarassenko et al.
2007/0179371 A1 8/2007 Peyser et al.
2007/0185393 A1 8/2007 Zhou
2007/0191002 A1 8/2007 Ge
2007/0196456 A1 8/2007 Stevens
2007/0207793 A1 9/2007 Myer
2007/0208233 A1 9/2007 Kovacs
2007/0213659 A1 9/2007 Trovato et al.
2007/0237719 A1 10/2007 Jones
2007/0244370 A1 10/2007 Kuo et al.
2007/0255198 A1 11/2007 Leong et al.
2007/0255330 A1 11/2007 Lee
2007/0270672 A1 11/2007 Hayter
2007/0279217 A1 12/2007 Venkatraman
2007/0282174 A1 12/2007 Sabatino
2007/0282177 A1 12/2007 Pilz
2007/0299480 A1 12/2007 Hill
2008/0000804 A1 1/2008 Carey et al.
2008/0014866 A1 1/2008 Lipowshi
2008/0020037 A1 1/2008 Robertson et al.
2008/0021519 A1 1/2008 DeGeest
2008/0021521 A1 1/2008 Shah
2008/0027679 A1 1/2008 Shklarski
2008/0033273 A1 2/2008 Zhou
2008/0038588 A1 2/2008 Lee
2008/0039700 A1 2/2008 Drinan et al.
2008/0045843 A1 2/2008 Tsuji et al.
2008/0046038 A1 2/2008 Hill
2008/0051647 A1 2/2008 Wu et al.
2008/0051667 A1 2/2008 Goldreich
2008/0058614 A1 3/2008 Banet
2008/0062856 A1 3/2008 Feher
2008/0065168 A1 3/2008 Bitton et al.
2008/0074307 A1 3/2008 Boric-Lubecke
2008/0077015 A1 3/2008 Botic-Lubecke
2008/0077028 A1 3/2008 Schaldach et al.
2008/0077188 A1 3/2008 Denker et al.
2008/0091089 A1 4/2008 Guillory et al.
2008/0091114 A1 4/2008 Min
2008/0097549 A1 4/2008 Colbaugh
2008/0097917 A1 4/2008 Dicks
2008/0103440 A1 5/2008 Ferren et al.
2008/0112885 A1 5/2008 Okunev et al.
2008/0114224 A1 5/2008 Bandy et al.
2008/0119705 A1 5/2008 Patel
2008/0119716 A1 5/2008 Boric-Lubecke
2008/0121825 A1 5/2008 Trovato et al.
2008/0137566 A1 6/2008 Marholev
2008/0139907 A1 6/2008 Rao et al.
2008/0140403 A1 6/2008 Hughes et al.
2008/0146871 A1 6/2008 Arneson et al.
2008/0146889 A1 6/2008 Young
2008/0146892 A1 6/2008 LeBoeuf
2008/0154104 A1 6/2008 Lamego
2008/0166992 A1 7/2008 Ricordi
2008/0175898 A1 7/2008 Jones et al.
2008/0183245 A1 7/2008 Van Oort
2008/0188837 A1 8/2008 Belsky et al.
2008/0194912 A1 8/2008 Trovato et al.
2008/0208009 A1 8/2008 Shklarski
2008/0214901 A1 9/2008 Gehman
2008/0214985 A1 9/2008 Yanaki
2008/0243020 A1 10/2008 Chou
2008/0249360 A1 10/2008 Li
2008/0262320 A1 10/2008 Schaefer et al.
2008/0262336 A1 10/2008 Ryu
2008/0269664 A1 10/2008 Trovato et al.
2008/0275312 A1 11/2008 Mosesov
2008/0284599 A1 11/2008 Zdeblick et al.
2008/0288027 A1 11/2008 Kroll
2008/0294020 A1 11/2008 Sapounas
2008/0299197 A1 12/2008 Toneguzzo et al.
2008/0300572 A1 12/2008 Rankers
2008/0303638 A1 12/2008 Nguyen
2008/0306357 A1 12/2008 Korman
2008/0306359 A1 12/2008 Zdeblick et al.
2008/0306360 A1 12/2008 Robertson et al.
2008/0311852 A1 12/2008 Hansen
2008/0312522 A1 12/2008 Rowlandson
2008/0316020 A1 12/2008 Robertson
2009/0009330 A1 1/2009 Sakama et al.
2009/0009332 A1 1/2009 Nunez et al.
2009/0024045 A1 1/2009 Prakash
2009/0024112 A1 1/2009 Edwards et al.
2009/0030293 A1 1/2009 Cooper et al.
2009/0030297 A1 1/2009 Miller
2009/0034209 A1 2/2009 Joo
2009/0043171 A1 2/2009 Rule
2009/0047357 A1 2/2009 Tomohira et al.
2009/0048498 A1 2/2009 Riskey
2009/0062634 A1 3/2009 Say et al.
2009/0062670 A1 3/2009 Sterling
2009/0062730 A1 3/2009 Woo
2009/0069642 A1 3/2009 Gao
2009/0069655 A1 3/2009 Say et al.
2009/0069656 A1 3/2009 Say et al.
2009/0069657 A1 3/2009 Say et al.
2009/0069658 A1 3/2009 Say et al.
2009/0069724 A1 3/2009 Otto et al.
2009/0076343 A1 3/2009 James
2009/0076350 A1 3/2009 Bly et al.
2009/0082645 A1 3/2009 Hafezi et al.
2009/0087483 A1 4/2009 Sison
2009/0088618 A1 4/2009 Ameson
2009/0099435 A1 4/2009 Say et al.
2009/0105561 A1 4/2009 Boydon et al.
2009/0110148 A1 4/2009 Zhang
2009/0112626 A1 4/2009 Talbot
2009/0124871 A1 5/2009 Arshak
2009/0124965 A1 5/2009 Greenberg et al.
2009/0131774 A1 5/2009 Sweitzer

(56) References Cited

U.S. PATENT DOCUMENTS

2009/0135886 A1 5/2009 Robertson et al.
2009/0142853 A1 6/2009 Warrington et al.
2009/0149839 A1 6/2009 Hyde et al.
2009/0157113 A1 6/2009 Marcotte
2009/0157358 A1 6/2009 Kim
2009/0161602 A1 6/2009 Matsumoto
2009/0163789 A1 6/2009 Say et al.
2009/0171180 A1 7/2009 Pering
2009/0171420 A1 7/2009 Brown et al.
2009/0173628 A1 7/2009 Say et al.
2009/0177055 A1 7/2009 Say et al.
2009/0177056 A1 7/2009 Say et al.
2009/0177057 A1 7/2009 Say et al.
2009/0177058 A1 7/2009 Say et al.
2009/0177059 A1 7/2009 Say et al.
2009/0177060 A1 7/2009 Say et al.
2009/0177061 A1 7/2009 Say et al.
2009/0177062 A1 7/2009 Say et al.
2009/0177063 A1 7/2009 Say et al.
2009/0177064 A1 7/2009 Say et al.
2009/0177065 A1 7/2009 Say et al.
2009/0177066 A1 7/2009 Say et al.
2009/0182206 A1 7/2009 Najafi
2009/0182207 A1 7/2009 Riskey et al.
2009/0182212 A1 7/2009 Say et al.
2009/0182213 A1 7/2009 Say et al.
2009/0182214 A1 7/2009 Say et al.
2009/0182215 A1 7/2009 Say et al.
2009/0182388 A1 7/2009 Von Arx
2009/0187088 A1 7/2009 Say et al.
2009/0187089 A1 7/2009 Say et al.
2009/0187090 A1 7/2009 Say et al.
2009/0187091 A1 7/2009 Say et al.
2009/0187092 A1 7/2009 Say et al.
2009/0187093 A1 7/2009 Say et al.
2009/0187094 A1 7/2009 Say et al.
2009/0187095 A1 7/2009 Say et al.
2009/0187381 A1 7/2009 King et al.
2009/0192351 A1 7/2009 Nishino
2009/0192368 A1 7/2009 Say et al.
2009/0192369 A1 7/2009 Say et al.
2009/0192370 A1 7/2009 Say et al.
2009/0192371 A1 7/2009 Say et al.
2009/0192372 A1 7/2009 Say et al.
2009/0192373 A1 7/2009 Say et al.
2009/0192374 A1 7/2009 Say et al.
2009/0192375 A1 7/2009 Say et al.
2009/0192376 A1 7/2009 Say et al.
2009/0192377 A1 7/2009 Say et al.
2009/0192378 A1 7/2009 Say et al.
2009/0192379 A1 7/2009 Say et al.
2009/0194747 A1 8/2009 Zou et al.
2009/0197068 A1 8/2009 Yamaguchi et al.
2009/0198115 A1 8/2009 Say et al.
2009/0198116 A1 8/2009 Say et al.
2009/0198175 A1 8/2009 Say et al.
2009/0203964 A1 8/2009 Shimizu et al.
2009/0203971 A1 8/2009 Sciarappa
2009/0203972 A1 8/2009 Heneghan
2009/0203978 A1 8/2009 Say et al.
2009/0204265 A1 8/2009 Hackett
2009/0210164 A1 8/2009 Say et al.
2009/0216101 A1 8/2009 Say et al.
2009/0216102 A1 8/2009 Say et al.
2009/0227204 A1 9/2009 Robertson et al.
2009/0227876 A1 9/2009 Tran
2009/0227940 A1 9/2009 Say et al.
2009/0227941 A1 9/2009 Say et al.
2009/0227988 A1 9/2009 Wood et al.
2009/0228214 A1 9/2009 Say et al.
2009/0231125 A1 9/2009 Baldus
2009/0234200 A1 9/2009 Husheer
2009/0243833 A1 10/2009 Huang
2009/0253960 A1 10/2009 Takenaka et al.
2009/0256702 A1 10/2009 Robertson
2009/0260212 A1 10/2009 Schmett et al.
2009/0264714 A1 10/2009 Chou
2009/0264964 A1 10/2009 Abrahamson
2009/0265186 A1 10/2009 Tarassenko et al.
2009/0273467 A1 11/2009 Elixmann
2009/0281539 A1 11/2009 Selig
2009/0287109 A1 11/2009 Ferren et al.
2009/0295548 A1 12/2009 Ronkka
2009/0296677 A1 12/2009 Mahany
2009/0303920 A1 12/2009 Mahany
2009/0306633 A1 12/2009 Trovato et al.
2009/0312619 A1 12/2009 Say et al.
2009/0318303 A1 12/2009 Delamarche et al.
2009/0318761 A1 12/2009 Rabinovitz
2009/0318779 A1 12/2009 Tran
2009/0318783 A1 12/2009 Rohde
2009/0318793 A1 12/2009 Datta
2010/0001841 A1 1/2010 Cardullo
2010/0010330 A1 1/2010 Rankers
2010/0033324 A1 2/2010 Shimizu et al.
2010/0036269 A1 2/2010 Ferren et al.
2010/0049004 A1 2/2010 Edman et al.
2010/0049006 A1 2/2010 Magar
2010/0049012 A1 2/2010 Dijksman et al.
2010/0049069 A1 2/2010 Tarassenko et al.
2010/0056878 A1 3/2010 Partin
2010/0056891 A1 3/2010 Say et al.
2010/0056939 A1 3/2010 Tarassenko et al.
2010/0057041 A1 3/2010 Hayter
2010/0062709 A1 3/2010 Kato
2010/0063438 A1 3/2010 Bengtsson
2010/0063841 A1 3/2010 D'Ambrosia et al.
2010/0069002 A1 3/2010 Rong
2010/0069717 A1 3/2010 Hafezi et al.
2010/0099967 A1 4/2010 Say et al.
2010/0099968 A1 4/2010 Say et al.
2010/0099969 A1 4/2010 Say et al.
2010/0100077 A1 4/2010 Rush
2010/0100078 A1 4/2010 Say et al.
2010/0106001 A1 4/2010 Say et al.
2010/0118853 A1 5/2010 Godfrey
2010/0139672 A1 6/2010 Kroll et al.
2010/0168659 A1 7/2010 Say et al.
2010/0179398 A1 7/2010 Say et al.
2010/0191073 A1 7/2010 Tarassenko et al.
2010/0210299 A1 8/2010 Gorbachov
2010/0222652 A1 9/2010 Cho
2010/0228113 A1 9/2010 Solosko
2010/0233026 A1 9/2010 Ismagliov et al.
2010/0234706 A1 9/2010 Gilland
2010/0234715 A1 9/2010 Shin
2010/0234914 A1 9/2010 Shen
2010/0245091 A1 9/2010 Singh
2010/0249541 A1 9/2010 Geva et al.
2010/0249881 A1 9/2010 Corndorf
2010/0256461 A1 10/2010 Mohamedali
2010/0259543 A1 10/2010 Tarassenko et al.
2010/0268048 A1 10/2010 Say et al.
2010/0268049 A1 10/2010 Say et al.
2010/0268050 A1 10/2010 Say et al.
2010/0274111 A1 10/2010 Say et al.
2010/0280345 A1 11/2010 Say et al.
2010/0280346 A1 11/2010 Say et al.
2010/0295694 A1 11/2010 Kauffman et al.
2010/0297640 A1 11/2010 Kumar et al.
2010/0298650 A1 11/2010 Moon et al.
2010/0298730 A1 11/2010 Tarassenko et al.
2010/0312188 A1 12/2010 Robertson et al.
2010/0312580 A1 12/2010 Tarassenko et al.
2011/0009715 A1 1/2011 O'Reilly et al.
2011/0077660 A1 3/2011 Janik et al.
2011/0124983 A1 5/2011 Kroll et al.
2011/0134906 A1 6/2011 Garudadri et al.
2011/0160549 A1 6/2011 Saroka et al.
2011/0224912 A1 9/2011 Bhavaraju et al.
2011/0230732 A1 9/2011 Edman et al.
2011/0270135 A1 11/2011 Dooley et al.
2012/0004520 A1 1/2012 Whitworth et al.
2012/0011699 A1 1/2012 Hafezi et al.

(56) References Cited

U.S. PATENT DOCUMENTS

| | | | | |
|---|---|---|---|---|
| 2012/0016231 | A1 | 1/2012 | Westmoreland | |
| 2012/0032816 | A1 | 2/2012 | Cho et al. | |
| 2012/0062371 | A1 | 3/2012 | Radivojevic et al. | |
| 2012/0071743 | A1 | 3/2012 | Todorov et al. | |
| 2012/0109112 | A1 | 5/2012 | Strand et al. | |
| 2012/0179004 | A1 | 7/2012 | Roesicke et al. | |
| 2012/0245043 | A1 | 9/2012 | England | |
| 2012/0276451 | A1 | 11/2012 | Lestriez et al. | |
| 2012/0299723 | A1 | 11/2012 | Hafezi et al. | |
| 2013/0129869 | A1 | 5/2013 | Hafezi et al. | |
| 2013/0129872 | A1 | 5/2013 | Kruger | |
| 2013/0171596 | A1 | 7/2013 | French | |
| 2013/0172690 | A1 | 7/2013 | Arne et al. | |
| 2013/0185228 | A1 | 7/2013 | Dresner | |
| 2013/0196012 | A1 | 8/2013 | Dill | |
| 2013/0199662 | A1* | 8/2013 | Gebbink ..... | B65D 47/00 141/2 |
| 2013/0209877 | A1 | 8/2013 | Kren et al. | |
| 2013/0223028 | A1 | 8/2013 | Arne et al. | |
| 2013/0275296 | A1 | 10/2013 | Tietzen et al. | |
| 2014/0066734 | A1 | 3/2014 | Zdeblick | |
| 2014/0179221 | A1 | 6/2014 | Whitworth et al. | |
| 2014/0180202 | A1 | 6/2014 | Zdeblick et al. | |
| 2014/0280125 | A1 | 9/2014 | Bhardwaj et al. | |
| 2014/0308930 | A1 | 10/2014 | Tran | |
| 2014/0349256 | A1 | 11/2014 | Connor | |
| 2014/0374276 | A1 | 12/2014 | Guthrie et al. | |
| 2015/0017486 | A1 | 1/2015 | Lai | |
| 2015/0059922 | A1 | 3/2015 | Thompson et al. | |
| 2015/0080678 | A1 | 3/2015 | Frank et al. | |
| 2015/0080680 | A1 | 3/2015 | Zdeblick et al. | |
| 2015/0112243 | A1 | 4/2015 | Hafezi et al. | |
| 2015/0127737 | A1 | 5/2015 | Thompson et al. | |
| 2015/0127738 | A1 | 5/2015 | Thompson et al. | |
| 2015/0149375 | A1 | 5/2015 | Thompson et al. | |
| 2015/0150480 | A1 | 6/2015 | Zdeblick et al. | |
| 2015/0164746 | A1 | 6/2015 | Costello et al. | |
| 2015/0230729 | A1 | 8/2015 | Zdeblick et al. | |
| 2015/0248833 | A1 | 9/2015 | Arne et al. | |
| 2015/0352343 | A1 | 12/2015 | Hafezi et al. | |
| 2015/0361234 | A1 | 12/2015 | Hafezi et al. | |
| 2016/0033667 | A1 | 2/2016 | Schmidt et al. | |
| 2016/0345906 | A1 | 12/2016 | Johnson et al. | |
| 2016/0380708 | A1 | 12/2016 | Dua et al. | |
| 2017/0000179 | A1 | 1/2017 | Cheng et al. | |
| 2017/0014046 | A1 | 1/2017 | Hafezi et al. | |
| 2017/0020182 | A1 | 1/2017 | Schmidt et al. | |
| 2017/0216569 | A1 | 8/2017 | Hafezi et al. | |
| 2017/0265813 | A1 | 9/2017 | Zdeblick et al. | |
| 2017/0274194 | A1 | 9/2017 | Robertson et al. | |
| 2017/0296799 | A1 | 10/2017 | Hafezi et al. | |
| 2018/0026680 | A1 | 1/2018 | Shirvani et al. | |
| 2018/0110441 | A1 | 4/2018 | Frank et al. | |
| 2018/0184698 | A1 | 7/2018 | Arne et al. | |
| 2018/0214048 | A1 | 8/2018 | Zdeblick et al. | |

FOREIGN PATENT DOCUMENTS

| | | |
|---|---|---|
| CN | 101795202 | 8/2010 |
| DE | 10313005 | 10/2004 |
| EP | 0344939 | 12/1989 |
| EP | 0526166 | 2/1993 |
| EP | 0981152 | 2/2000 |
| EP | 1246356 | 10/2002 |
| EP | 1534054 | 5/2005 |
| EP | 1702553 | 9/2006 |
| EP | 1244308 | 12/2007 |
| EP | 2143369 | 1/2010 |
| GB | 827762 | 2/1960 |
| JP | 61072712 | 4/1986 |
| JP | H01285247 | 11/1989 |
| JP | 05228128 | 9/1993 |
| JP | H11195415 | 7/1999 |
| JP | 2000506410 | 5/2000 |
| JP | 2002263185 | 9/2002 |
| JP | 2002282219 | 10/2002 |
| JP | 2003050867 | 2/2003 |
| JP | 2004313242 | 11/2004 |
| JP | 2005073886 | 3/2005 |
| JP | 2005087552 | 4/2005 |
| JP | 2005102959 | 4/2005 |
| JP | 2005124708 | 5/2005 |
| JP | 2005514966 | 5/2005 |
| JP | 2005304880 | 11/2005 |
| JP | 2005343515 | 12/2005 |
| JP | 20055332328 | 12/2005 |
| JP | 2006006377 | 1/2006 |
| JP | 2006509574 | 3/2006 |
| JP | 2007200739 | 8/2007 |
| JP | 2007313340 | 12/2007 |
| JP | 2009514870 | 4/2009 |
| JP | 2009528909 | 8/2009 |
| KR | 200600977523 | 7/2006 |
| TW | 200406192 | 5/2004 |
| TW | 200916136 | 4/2009 |
| WO | WO1988002237 | 4/1988 |
| WO | WO1992021307 | 12/1992 |
| WO | WO1993008734 | 5/1993 |
| WO | WO1993019667 | 10/1993 |
| WO | WO1994001165 | 1/1994 |
| WO | WO1997039963 | 10/1997 |
| WO | WO1998043537 | 10/1998 |
| WO | WO1999037290 | 7/1999 |
| WO | WO1999059465 | 11/1999 |
| WO | WO2000032474 | 6/2000 |
| WO | WO2000033246 | 6/2000 |
| WO | WO2001000085 | 1/2001 |
| WO | WO2001047466 | 7/2001 |
| WO | WO2001058236 | 8/2001 |
| WO | WO2001074011 | 10/2001 |
| WO | WO2001080731 | 11/2001 |
| WO | WO2002000920 | 1/2002 |
| WO | WO2002045489 | 6/2002 |
| WO | WO2002058330 | 7/2002 |
| WO | WO2002062276 | 8/2002 |
| WO | WO2002087681 | 11/2002 |
| WO | WO2002095351 | 11/2002 |
| WO | WO2003005877 | 1/2003 |
| WO | WO2003050643 | 6/2003 |
| WO | WO2003068061 | 8/2003 |
| WO | WO2004014225 | 2/2004 |
| WO | WO2004019172 | 3/2004 |
| WO | WO2004039256 | 5/2004 |
| WO | WO2004066833 | 8/2004 |
| WO | WO2004066834 | 8/2004 |
| WO | WO2004066903 | 8/2004 |
| WO | WO2004068881 | 8/2004 |
| WO | WO2004075032 | 9/2004 |
| WO | WO2004109316 | 12/2004 |
| WO | WO2005011237 | 2/2005 |
| WO | WO2005020023 | 3/2005 |
| WO | WO2005024687 | 3/2005 |
| WO | WO2005041438 | 5/2005 |
| WO | WO2005047837 | 5/2005 |
| WO | WO2005051166 | 6/2005 |
| WO | WO2005053517 | 6/2005 |
| WO | WO2005083621 | 9/2005 |
| WO | WO2005110238 | 11/2005 |
| WO | WO2005123569 | 12/2005 |
| WO | WO2006021932 | 3/2006 |
| WO | WO2006027586 | 3/2006 |
| WO | WO2006028347 | 3/2006 |
| WO | WO2006055892 | 5/2006 |
| WO | WO2006055956 | 5/2006 |
| WO | WO2006075016 | 7/2006 |
| WO | WO2006100620 | 9/2006 |
| WO | WO2006104843 | 10/2006 |
| WO | WO2006116718 | 11/2006 |
| WO | WO2006127355 | 11/2006 |
| WO | WO2007001724 | 1/2007 |
| WO | WO2007001742 | 1/2007 |

(56) References Cited

FOREIGN PATENT DOCUMENTS

| | | |
|---|---|---|
| WO | WO2007013952 | 2/2007 |
| WO | WO2007014084 | 2/2007 |
| WO | WO2007014527 | 2/2007 |
| WO | WO2007021496 | 2/2007 |
| WO | WO2007027660 | 3/2007 |
| WO | WO2007028035 | 3/2007 |
| WO | WO2007036687 | 4/2007 |
| WO | WO2007036741 | 4/2007 |
| WO | WO2007036746 | 4/2007 |
| WO | WO2007040878 | 4/2007 |
| WO | WO2007067054 | 6/2007 |
| WO | WO2007071180 | 6/2007 |
| WO | WO2007096810 | 8/2007 |
| WO | WO2007101141 | 9/2007 |
| WO | WO2007115087 | 10/2007 |
| WO | WO2007120946 | 10/2007 |
| WO | WO2007127316 | 11/2007 |
| WO | WO2007127879 | 11/2007 |
| WO | WO2007128165 | 11/2007 |
| WO | WO2007130491 | 11/2007 |
| WO | WO2007143535 | 12/2007 |
| WO | WO2007149546 | 12/2007 |
| WO | WO2008008281 | 1/2008 |
| WO | WO2008012700 | 1/2008 |
| WO | WO2008030482 | 3/2008 |
| WO | WO2008052136 | 5/2008 |
| WO | WO2008063626 | 5/2008 |
| WO | WO2008066617 | 6/2008 |
| WO | WO2008076464 | 6/2008 |
| WO | WO2008089232 | 7/2008 |
| WO | WO2008091683 | 7/2008 |
| WO | WO2008095183 | 8/2008 |
| WO | WO2008097652 | 8/2008 |
| WO | WO2008101107 | 8/2008 |
| WO | WO2008112577 | 9/2008 |
| WO | WO2008112578 | 9/2008 |
| WO | WO2008120156 | 10/2008 |
| WO | WO2008133394 | 11/2008 |
| WO | WO2008134185 | 11/2008 |
| WO | WO2008150633 | 12/2008 |
| WO | WO2009000447 | 12/2008 |
| WO | WO2009001108 | 12/2008 |
| WO | WO2009006615 | 1/2009 |
| WO | WO2009029453 | 3/2009 |
| WO | WO2009031149 | 3/2009 |
| WO | WO2009036334 | 3/2009 |
| WO | WO2009051829 | 4/2009 |
| WO | WO2009051830 | 4/2009 |
| WO | WO2009063377 | 5/2009 |
| WO | WO2009081348 | 7/2009 |
| WO | WO2009111664 | 9/2009 |
| WO | WO2009146082 | 12/2009 |
| WO | WO2010009100 | 1/2010 |
| WO | WO2010011833 | 1/2010 |
| WO | WO2010019778 | 2/2010 |
| WO | WO2010057049 | 5/2010 |
| WO | WO2010080765 | 7/2010 |
| WO | WO2010080843 | 7/2010 |
| WO | WO2010107563 | 9/2010 |
| WO | WO2010129288 | 11/2010 |
| WO | WO2010132331 | 11/2010 |
| WO | WO2010135516 | 11/2010 |
| WO | WO2011068963 | 6/2011 |
| WO | WO2011133799 | 10/2011 |
| WO | WO2011159336 | 12/2011 |
| WO | WO2011159337 | 12/2011 |
| WO | WO2011159338 | 12/2011 |
| WO | WO2011159339 | 12/2011 |
| WO | WO2012112561 | 8/2012 |
| WO | WO2015112603 | 7/2015 |
| WO | WO2015112604 | 7/2015 |
| WO | WO2015119911 | 8/2015 |

OTHER PUBLICATIONS

Arshak et al., A Review and Adaptation of Methods of Object Tracking to Telemetry Capsules IC-Med (2007) vol. 1, No. 1, Issue 1, 12pp.

"ASGE Technology Status Evaluation Report: wireless capsule endoscopy" American Soc. For Gastrointestinal Endoscopy (2006) vol. 63, No. 4; 7 pp.

Au-Yeung, K., et al., "A Networked System for Self-Management of Drug Therapy and Wellness", Wireless Health '10, Oct. 5-7, 2010, San Diego, 9 pages.

Aydin et al., "Design and implementation considerations for an advanced wireless interface in miniaturized integrated sensor Microsystems" Sch. of Eng. & Electron., Edinburgh Univ., UK; (2003); abstract (1 page).

Barrie, Heidelberg pH capsule gastric analysis. Texbook of Natural Medicine, (1992), Pizzorno, Murray & Barrie (4 pages).

Bohidar et al., "Dielectric Behavior of Gelatin Solutions and Gels" Colloid Polym Sci (1998) 276:81-86.

Brock, "Smart Medicine: The Application of Auto-ID Technology to Healthcare" Auto-ID Labs (2002) http://www.autoidlabs.org/uploads/media/MIT-AUTOID-WH-010.pdf (14 pages).

Carlson et al., "Evaluation of a non-invasive respiratory monitoring system for sleeping subjects" Physiological Measurement (1999) 20(1): 53.

Coury, L. "Conductance Measurement Part 1: Theory"; Current Separations, 18:3 (1999) p. 91-96.

Delvaux et al., "Capsule endoscopy: Technique and indications" Clinical Gastroenterology (2008) vol. 22, Issue 5, pp. 813-837.

Description of ePatch Technology Platform for ECG and EMG, located it http://www.madebydelta.com/imported/images/DELTA_Web/documents/ME/ePatch_ECG_EMG.pdf, Dated Sep. 2, 2010; 1 page.

Dhar et al., "Electroless nickel plated contacts on porous silicon" Appl. Phys. Lett. 68 (10) pp. 1392-1393 (1996).

Eldek A., "Design of double dipole antenna with enhanced usable bandwidth for wideband phased array applications" Progress in Electromagnetics Research PIER 59, 1-15 (2006).

Fawaz et al., "Enhanced Telemetry System using CP-QPSK Band—Pass Modulation Technique Suitable for Smart Pill Medical Application" IFIP IEEE Dubai Conference (2008); http://www.asic.fh-offenburg.de/downloads/ePille/IFIP_IEEE_Dubai_Conference.pdf (5 pages).

Ferguson et al., "Dielectric Constant Studies III Aqueous Gelatin Solutions" J. Chem. Phys. 2, 94 (1934) p. 94-98.

Furse C. M., "Dipole Antennas" J. Webster (ed). Wiley Encyclopedia of Electrical and Electronics Engineering (1999) p. 575-581.

Gaglani S. "Put Your Phone, or Skin, on Vibrate" MedGadget (2012) http://medgadget.com/2012/03/put-your-phone-or-skin-on-vibrate.html 8pp.

Gilson, D.R. "Molecular dynamics simulation of dipole interactions", Department of Physics, Hull University, (Dec. 2002), p. 1-43.

Given Imaging, "Agile Patency Brochure" (2006) http://www.inclino.no/documents/AgilePatencyBrochure_Global_GMB-0118-01.pdf, 4pp.

Gonzalez-Guillaumin et al., "Ingestible capsule for impedance and pH monitoring in the esophagus" IEEE Trans Biomed Eng. (2007) 54(12): 2231-6; abstract.

Greene, "Edible RFID microchip monitor can tell if you take your medicine" Bloomberg Businessweek (2010) 2 pp.; http://www.businessweek.com/idg/2010-03-31/edible-rfid-microchip-monitor-can-tell-if-you-take-your-medicine.html (1 page).

Heydari et al., "Analysis of the PLL jitter due to power/ground and substrate noise"; IEEE Transactions on Circuits and Systems (2004) 51(12): 2404-16.

Hoeksma, J. "New 'smart pill' to track adherence" E-Health-Insider (2010) http://www.e-health-insider.com/news/5910/new_'smart_pill'_monitors_medicines (1 page).

Hoover et al., "Rx for health: Engineers design pill that signals it has been swallowed" University of Florida News (2010) 2pp.; http://news.ufl.edu/2010/03/31/antenna-pill-2/.

Intromedic, MicroCam Innovative Capsule Endoscope Pamphlet. (2006) 8 pp (http://www.intromedic.com/en/product/productinfo.asp) (8 pages).

(56) References Cited

OTHER PUBLICATIONS

ISFET—Ion Sensitive Field-Effect Transistor; MICROSENS S.A. pdf document. First Office Action (dated Jun. 13, 2011) for U.S. Appl. No. 12/238,345; 4pp.
Jung, S. "Dissolvable 'Transient Electronics' Will Be Good for Your Body and the Environment" MedGadget; (Oct. 1, 2012); Onlne website: http://medgadget.com/2012/10/dissolvable-transient-electronics-will-be-good-for-your-body-and-the-environment.html; downloaded Oct. 24, 2012; 4 pp.
Juvenile Diabetes Research Foundation International (JDRF), "Artificial Pancreas Project" (2010); http://www.artificialpancreasproject.com/; 3 pp.
Kamada K., "Electrophoretic deposition assisted by soluble anode" Materials Letters 57 (2003) 2348-2351.
Kendle, Earl R. and Morris, Larry A., "Preliminary Studies in the Development of a Gastric Battery for Fish" (1964). Nebraska Game and Parks Commission White Papers, Conference Presentations, & Manuscripts. Paper 22. p. 1-6.
Kim et al., "A Semi-Interpenetrating Network System for a Polymer Membrane"; Eur. Polym. J. vol. 33 No. 7; pp. 1009-1014 (1997).
Li, P-Y, et al. "An electrochemical intraocular drug delivery device", Sensors and Actuators A 143 (2008) p. 41-48.
Lifescan, "OneTouch UltraLink™"http://www.lifescan.com/products/meters/ultralink (2010) 2 pp.
MacKay et al., "Radio Telemetering from within the Body" Inside Information is Revealed by Tiny Transmitters that can be Swallowed or Implanted in Man or Animal Science (1991) 1196-1202; 134; American Association for the Advancement of Science, Washington D.C.
MacKay et al., "Endoradiosonde" Nature, (1957) 1239-1240, 179 Nature Publishing Group.
McKenzie et al., "Validation of a new telemetric core temperature monitor" J. Therm. Biol. (2004) 29(7-8):605-11.
Medtronic, "CareLink Therapy Management Software for Diabetes" (2010); https://carelink.minimed.com/patient/entry.jsp?bhcp=1; 1 pp.
Medtronic, "Carelink™ USB" (2008) http://www.medtronicdiabetes.com/pdf/carelink_usb_factsheet.pdf 2pp.
Medtronic "The New MiniMed Paradigm® REAL-Time Revel™ System" (2010) http://www.medtronicdiabetes.com/products/index.html; 2 pp.
Medtronic, "Mini Med Paradigm® Revel™ Insulin Pump" (2010) http://www.medtronicdiabetes.com/products/insulinpumps/index.html; 2 pp.
Medtronic, Mini Med Paradigm™ Veo™ System: Factsheet (2010). http://www.medtronic-diabetes.com.au/downloads/Paradigm%20Veo%20Factsheet.pdf ; 4 pp.
Melanson, "Walkers swallow RFID pills for science" Engadget (2008); http://www.engadget.com/2008/07/29/walkers-swallow-rfid-pills-for-science/ (1 page).
Minimitter Co. Inc. "Actiheart" Traditional 510(k) Summary. (Sep. 27, 2005) (8 pages).
Minimitter Co. Inc. Noninvasive technology to help your studies succeed. Mini Mitter.com (Mar. 31, 2009) (4 pages).
Mini Mitter Co, Inc. 510(k) Premarket Notification Mini-Logger for Diagnostic Spirometer. 9-21 (1999) (9 pages).
Mini Mitter Co, Inc. 510(k) Premarket Notification for VitalSense. Apr. 22, 2004 (11 pages).
MiniMitter Co. Inc. VitalSense Integrated Physiological Monitoring System. Product Description. (2005) (4 pages).
MiniMitter Co. Inc. VitalSense Wireless Vital Signs Monitoring. Temperatures.com Mar. 31, 2009 (3 pages).
Mojaverian et al., "Estimation of gastric residence time of the Heidelberg capsule in humans: effect of varying food composition" Gastroenterology (1985) 89:(2): 392-7.
O'Brien et al., "The Production and Characterization of Chemically Reactive Porous Coatings of Zirconium Via Unbalanced Magnetron Sputtering" Surface and Coatings Technology (1996) 86-87; 200-206.
Park, "Medtronic to Buy MiniMed for $3.7 Billion" (2001) HomeCare; http://homecaremag.com/mag/medical_medtronic_buy_minimed/; 2 pp.
Philips Respironics Products, Noninvasive Technology to Help Your Studies Succeed. 510 (k) Permanent Notification for Vital Sense. Apr. 22, 2004; http/minimitter.com/products.cfm.
Radio Antennae, http://www.erikdeman.de/html/sail018h.htm; (2008) 5 pages.
"RFID "pill" monitors marchers" RFID News (2008) http://www.rfidnews.org/2008/07/23/rfid-pill-monitors-marchers/ (4 pages).
Rolison et al., "Electrically conductive oxide aerogels: new materials in electrochemistry" J. Mater. Chem. (2001) 1, 963-980.
Roulstone, et al., "Studies on Polymer Latex Films: I. A study of latex film morphology" Polymer International 24 (1991) pp. 87-94.
Sanduleanu et al., "Octave tunable, highly linear, RC-ring oscillator with differential fine-coarse tuning, quadrature outputs and amplitude control for fiber optic transceivers" (2002) IEEE MTT-S International Microwave Symposium Digest 545-8.
Santini, J.T. et al, "Microchips as controlled drug delivery-devices", Agnew. Chem. Int. Ed. (2000), vol. 39, p. 2396-2407.
"SensiVida minimally invasive clinical systems" Investor Presentation (Oct. 2009) 28pp; http://www.sensividamedtech.com/SensiVidaGeneralOctober09.pdf; pp. 1-28.
Shawgo, R.S. et al. "BioMEMS from drug delivery", Current Opinion in Solid State and Material Science 6 (2002), p. 329-334.
Shin et al., "A Simple Route to Metal Nanodots and Nanoporous Metal Films"; Nano Letters, vol. 2, No. 9 (2002) pp. 933-936.
Shrivas et al., "A New Platform for Bioelectronics—Electronic Pill", Cummins College, (2010).; http://www.cumminscollege.org/downloads/electronics_and_telecommunication/Newsletters/Current%20Newsletters.pdf; First cited in third party client search conducted by Patent Eagle Search May 18, 2010 (2010); pp. 11-12.
"Smartlife awarded patent for knitted transducer" Innovation in Textiles News: http://www.innovationintextiles.com/articles/208.php; 2pp. (2009).
"The SmartPill Wireless Motility Capsule" SmartPill, The Measure of GI Health; (2010) http://www.smartpillcorp.com/index.cfm?pagepath=Products/The_SmartPill_Capsule&id=17814 (1 page).
Solanas et al., "RFID Technology for the Health Care Sector" Recent Patents on Electrical Engineering (2008) 1, 22-31.
Soper, S.A. et al. "Bio-Mems Technologies and Applications", Chapter 12, "MEMS for Drug Delivery", p. 325-346 (2007).
Swedberg, "University Team Sees Ingestible RFID Tag as a Boon to Clinical Trials" RFID Journal (Apr. 27, 2010); http://www.rfidjournal.com/article/view/7560/1 3pp.
Tajalli et al., "Improving the power-delay performance in subthreshold source-coupled logic circuits" Integrated Circuit and System Design. Power and Timing Modeling, Optimization and Simulation, Springer Berlin Heidelberg (2008) 21-30.
Target Innovations, Tablet Metal Detector, https ://web. arch ive. org/web/20 130215063351 /http://www. metaldetectorindia.com/tablet -metal-detector. html, Feb. 15, 2013.
TargetPharmaceutical Metal Detector, Feb. 15, 2013 downloaded from Target Innovations, Tablet Metal Detector, Feb. 15, 2013.
Tatbul et al., "Confidence-based data management for personal area sensor networks" ACM International Conference Proceeding Series (2004) 72; 3 pages.
Tierney, M.J. et al "Electroreleasing Composite Membranes for Delivery of Insulin and other Biomacromolecules", J. Electrochem. Soc., vol. 137, No. 6, (Jun. 1990), p. 2005-2006.
Trutag Technologies, Inc., Spectral Microtags for Authentication and Anti-Counterfeiting; "Product Authentication and Brand Protection Solutions"; http://www.trutags.com/; downloaded Feb. 12, 2013; 1 pp.
Walkey, "MOSFET Structure and Processing"; 97.398 Physical Electronics Lecture 20; 24 pages, First Office Action (dated Jun. 13, 2011) for U.S. Appl. No. 12/238,345.
Wang, X. et al "Resistance to Tracking and Erosion of Silicone Rubber Material under Various Types of Precipitation", Jpn. J. Appl. Phys. vol. 38 (1999) pp. 5170-5175.
Watson, et al., "Determination of the relationship between the pH and conductivity of gastric juice" Physiol Meas. 17 (1996) pp. 21-27.

(56) References Cited

OTHER PUBLICATIONS

Winter, J. et al. "The material properties of gelatin gels"; USA Ballistic Research Laboratories, (Mar. 1975), p. 1-157.
Wongmanerod et al., "Determination of pore size distribution and surface area of thin porous silicon layers by spectroscopic ellipsometry" Applied Surface Science 172 (2001) 117-125.
Xiaoming et al., "A telemedicine system for wireless home healthcare based on bluetooth and the internet" Telemedicine Journal and e-health (2004) 10(S2): S110-6.
Yang et al., "Fast-switching frequency synthesizer with a discriminator-aided phase detector" IEEE Journal of Solid-State Circuits (2000) 35(10): 1445-52.
Yao et al., "Low Power Digital Communication in Implantable Devices Using Volume Conduction of Biological Tissues" Proceedings of the 28th IEEE, EMBS Annual International Conference, (Aug. 30-Sep. 3, 2006); pp. 6249-6252.
Youtube video Pharmaceutical Metal Detector/Tablet Metal Detector/ Capsule Metal Detector/ Dry Fruits; https://www.youtube.com/watch?v=I0126txam_s, May 12, 2012.
Zimmerman, "Personal Area Networks: Near-field intrabody communication" IBM Systems Journal (1996) 35 (3-4):609-17.
Zworykin, "A Radio Pill" Nature, (1957) 898, 179 Nature Publishing Group.

* cited by examiner

CONTAINER WITH ELECTRONICALLY CONTROLLED INTERLOCK

CROSS-REFERENCE TO RELATED APPLICATIONS

This application is a continuation application claiming priority under 35 U.S.C. § 120 to U.S. patent application Ser. No. 14/469,381, titled CONTAINER WITH ELECTRONICALLY CONTROLLED INTERLOCK, filed on Aug. 26, 2014, now U.S. Pat. No. 9,796,576, which application claims the benefit under 35 U.S.C. § 119(e) of U.S. Provisional Patent Application No. 61/872,454, titled CONTAINER WITH ELECTRONICALLY CONTROLLED INTERLOCK, filed Aug. 30, 2013, the entire disclosures of which are hereby incorporated by reference herein.

INTRODUCTION

Containers that can be filled, emptied, and refilled are attractive to consumers for a variety of reasons. Besides cutting down on post-consumer waste, reusable containers can also be customized for a variety of purposes. The customization may range from attractive aesthetic design, to specialized shapes and sizes based on what is to be contained and where the container might be used or mounted. "Smart" or "digital" containers offering a wide range of high tech uses besides simply serving as a receptacle for various materials.

Supplying a customized reusable container for use with a particular product or line of products may be a valuable marketing strategy for suppliers of various consumable products. A potential downfall with this strategy is the potential for the consumer to use the customized container to hold products other than what was intended, perhaps even the products of competitors, or unsafe or dangerous products. Therefore it would be desirable to have a customizable container that is restricted for use to a particular product or line of products.

For example, a supplier of a beverage used by avid bicyclists might want to attract potential purchasers by providing an attractive custom designed bottle that could be mounted on a bicycle. The problem is that once the customized bottle is purchased or even given away to the consumer, there is nothing that would prevent the consumer from later using the bottle with a competitor's beverage or simply even water. The marketing strategy would be more desirable for the beverage supplier if the bottle itself could restrict its use to only the beverages or lines of beverages of that particular supplier.

Another example of a customizable container might be a "smart" container capable of monitoring how much material enters or is expelled from the container. Such a container may be useful to someone interested in tracking the amount of food, drink, medication, or supplements ingested by the user of the container. An alternative use for this type of customization could also be using the container as a measuring device, i.e. instead of using a measuring spoon or cup the material could be measured as poured. The customized container may also monitor or measure calories ingested by the user of the container as or when a portion of the contents of the container is consumed.

Further customization could include a container that tracks the time and date materials or product are placed inside a container as well as when the contents are ultimately removed, e.g., consumed.

Should such containers exist, they would not just be attractive marketing tools for suppliers of beverages, but could be used with other ingestible items such as dried cereal, medication, gumballs, candy, pet food, spices, and baking supplies. They could also be attractive for suppliers of items such as laundry soap, shampoo, and cleaning supplies.

Logically speaking, the more customized and attractive the container, the more expensive it may be. Therefore, the option for recouping that cost may be limited to either charging more for the container itself, or spreading the cost recovery over time with the price of the consumable to be placed within the container. Recovering the cost by linking it to supplying the consumable instead of to a one-time purchase price of the container may result in higher profits in the long run. In order to maximize the continual purchasing of a particular product to be used with the container, it would be extremely helpful to restrict a container's use to only a particular product or line of products belonging to the container's supplier.

SUMMARY

The following aspects of the invention are described and illustrated in conjunction with systems, tool and methods which are meant to be exemplary and illustrative, not limiting in scope.

The apparatus and methods of the invention utilize a container having an interlock that prevents filling the container, dispensing from the container, or both, as well as a detecting mechanism that senses a unique identifier associated with a particular product allowing its use in conjunction with the container.

One aspect of the apparatus of the invention includes a container, for example, a bottle, that has a device which prevents material such as a sports energy drink (also referred to as an electrolyte replacement beverage) from being poured into the bottle, unless an interlock device is activated which allows the bottle to be opened for filling.

Another aspect of the apparatus of the invention includes a container, for example, a bottle, that has a device which permits material to enter the bottle, such as a sports energy drink. However, the bottle contains an interlock device which prevents the contents of the bottle from being expelled from the bottle in a convenient or useful manner, unless the interlock device is properly activated. In some aspects of the invention, where the interlock device prevents material from exiting the bottle, there may be a secondary exit valve which may be opened, for example on the side of the bottle, or at the bottom of the bottle, which would allow the bottle to be emptied or cleaned, in the absence of the successful operation of the interlock device. This would also allow for thermal expansion relief, for example, in the event that a carbonated beverage develops pressure requiring release. As can be appreciated, the secondary opening/exit valve would be less desirable to use than the intended opening controlled by the interlock device.

The interlock devices of various aspects of the invention may operate and be controlled in a variety of different ways depending on the application and needs of a particular container. In many cases the interlock device would be controlled by a system of sensors and unique identifiers (IDs) followed by an analysis of whether a unique identifier is acceptable. Depending on the result of the analysis, an instruction is communicated to the interlock device, either opening it, or causing it to remain closed. It should be appreciated that a different method of the invention would simply not communicate a message at all to the interlock device if a unique identifier is deemed unacceptable or is rejected.

An exemplary aspect of the invention includes a customized container with a sensor and an interlock that is operated by first sensing a unique identifier that is associated in some way with a product that the user intends to fill the customized container. If a unique identifier of the product sensed and is deemed acceptable through an analysis after it sensed then an instruction is provided to the interlock to open thereby allowing the user to transfer the product into the customized container.

In an aspect of the invention, the customized container is a bottle. The desired product may also be contained in a bottle, having a cap which is capable of being re-attached once it is removed. In this aspect of the invention, the cap may contain the unique identifier. The method of an aspect of the invention may include the step of removing the cap with a unique identifier from the bottle of the desired product. The cap is then attached to a portion of the customized bottle (for example a threaded receiver) that provides a sensor for sensing the unique identifier contained upon the cap. If a unique identifier is sensed and an analysis indicates that the unique identifier is acceptable, an instruction is provided to the interlock to open, allowing the desired product to enter the customized container. Alternatively, the interlock may allow product to enter the customized container, but prevent the product from exiting the container as intended if an analysis of the cap indicates that it is not an acceptable unique identifier.

Aspects of the invention may implement the unique identifier and appropriate sensor in different ways. As mentioned above, the unique identifier may be included in a cap or lid of a container holding a product desired to be placed in the customizable container of the invention. Alternatively, a unique identifier may be placed on a removable sticker that can be removed from the container holding the desired product and placed near or on the customizable container for sensing. Another option would be to place the unique identifier on the container of the desired product in a position that may be sensed with a sensor on the customizable bottle. Current technology would also allow a unique identifier to be contained in the product itself that is desired to be placed in the customizable container. In some aspects of the invention, the customizable container may include a system for performing spectrometry on the material desired to be contained within the customizable container. Another aspect of the invention may incorporate nanotechnology to provide a unique identifier for selective activation of the customizable container's interlock device.

A clever individual may attempt to circumvent the technology of the interlock system for a new supply of product by reusing the unique identifier for a previous supply of product. For example, in an aspect of the invention where the unique identifier is contained in a cap, an individual may save the cap and use it to operate the interlock again the next time it is desired to fill the customizable container. Therefore, a further aspect of the invention includes a memory in the customizable container that will record a value for a unique identifier at the time the sensor senses it. Part of the later analysis which determines whether a unique identifier is acceptable will also include comparing the unique identifier to the values stored in that memory. If the unique identifier had already been used, then an instruction to open the interlock would not be provided. As can be appreciated, the system could alternatively be designed to allow a limited number of uses for a particular unique identifier as well. Unique identifiers could also expire if they are not used within a certain period of time, or can only be used repeatedly for a certain period of time.

Similarly, another aspect of the invention which would serve to prevent circumvention of the interlock by reusing the same unique identifier at least a second time, would be to disable the unique identifier itself upon its use.

Aspects of the invention may utilize various types of containers. Additionally, the contents of the containers can also vary greatly. For example the customizable container may include bottles, sealable bags, hydration packs, sealable boxes, and other containers of various shapes and sizes. The contents may be liquid or pourable solids.

In addition to the exemplary aspects described above, further aspects of the invention will become apparent by reference to the accompanying drawings forming a part of this specification wherein like reference characters designate corresponding parts in the several views.

BRIEF DESCRIPTION OF THE DRAWINGS

Before explaining the disclosed aspects of the present invention in detail, it is to be understood that the invention is not limited in its application to the details of the particular arrangement shown, since the invention is capable of other aspects. Exemplary aspects are illustrated in referenced figures of the drawings. It is intended that the aspects and figures disclosed herein are to be considered illustrative rather than limiting. Also, the terminology used herein is for the purpose of description and not of limitation.

DETAILED DESCRIPTION OF THE DRAWINGS

Figure 1:
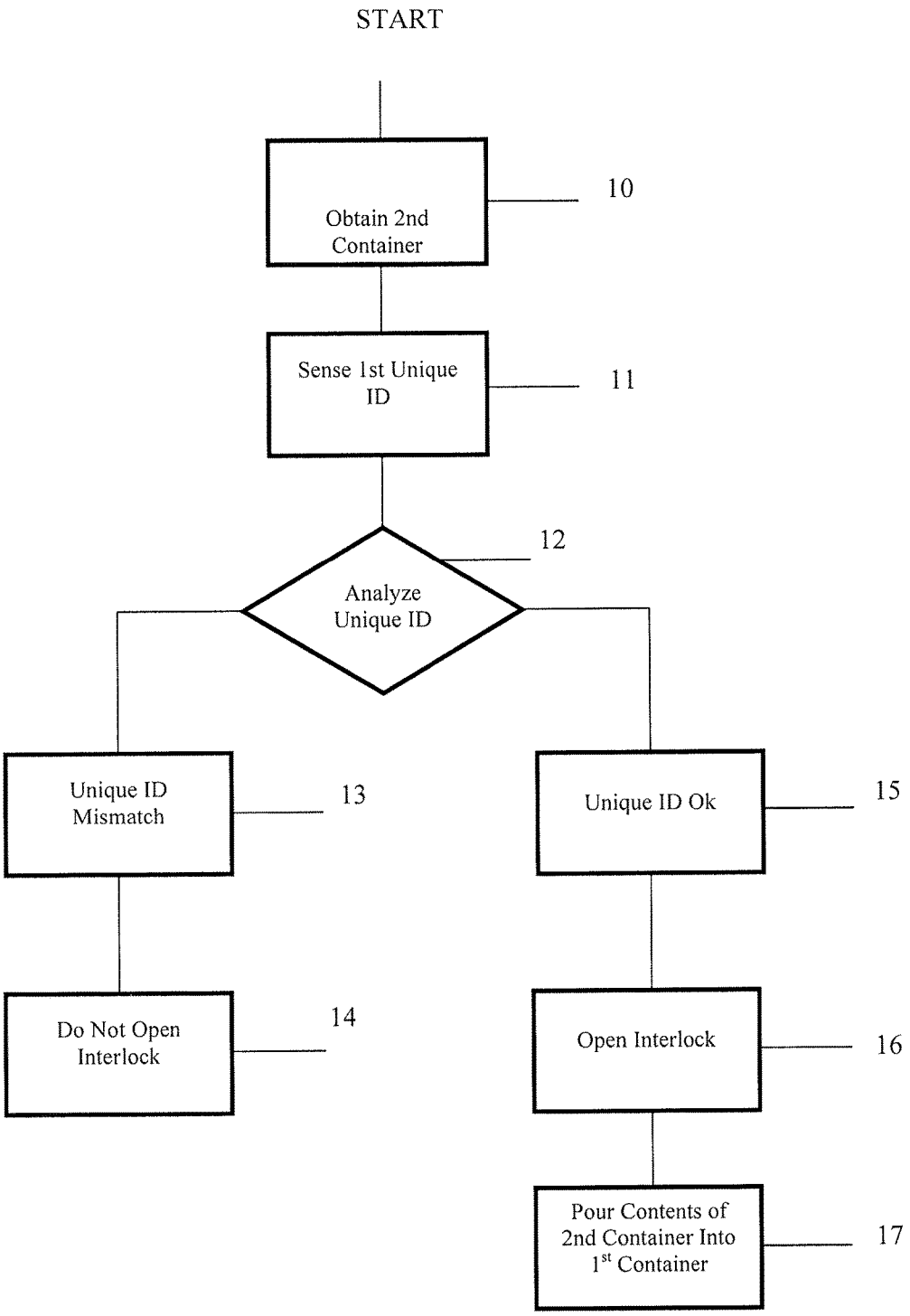
FIG. 1 is an illustration of an aspect of the method of the invention showing a unique identifier being sensed and causing an interlock to open or not open.

One aspect of the invention is illustrated in FIG. 1 and is a method for use with a first container. The first container comprises a sensor and an interlock device. The method comprises the step 10 of obtaining a second container. The second container comprises a first unique identifier (ID) and has contents. The method further comprises step 11 of sensing the first unique identifier of the second container with the sensor of the first container. The first unique identifier of the second container is analyzed in step 12 and yields a first result. Based on the first result, the method further comprises step 13 of providing an instruction to the interlock device. If the unique identifier does not match a predetermined set of acceptable values as in step 13 of the flowchart of FIG. 1, an interlock device on the first container remains closed and does not open to allow contents from the second container to be poured into the first container. This is shown in step 14 of FIG. 1. If the unique ID does match a predetermined set of acceptable values as in step 15 of FIG. 1, the interlock device of the first container opens as shown in step 16 of FIG. 1 and the contents of the second container may be poured into the first container. This is shown in step 17 of FIG. 1.

Figure 9:
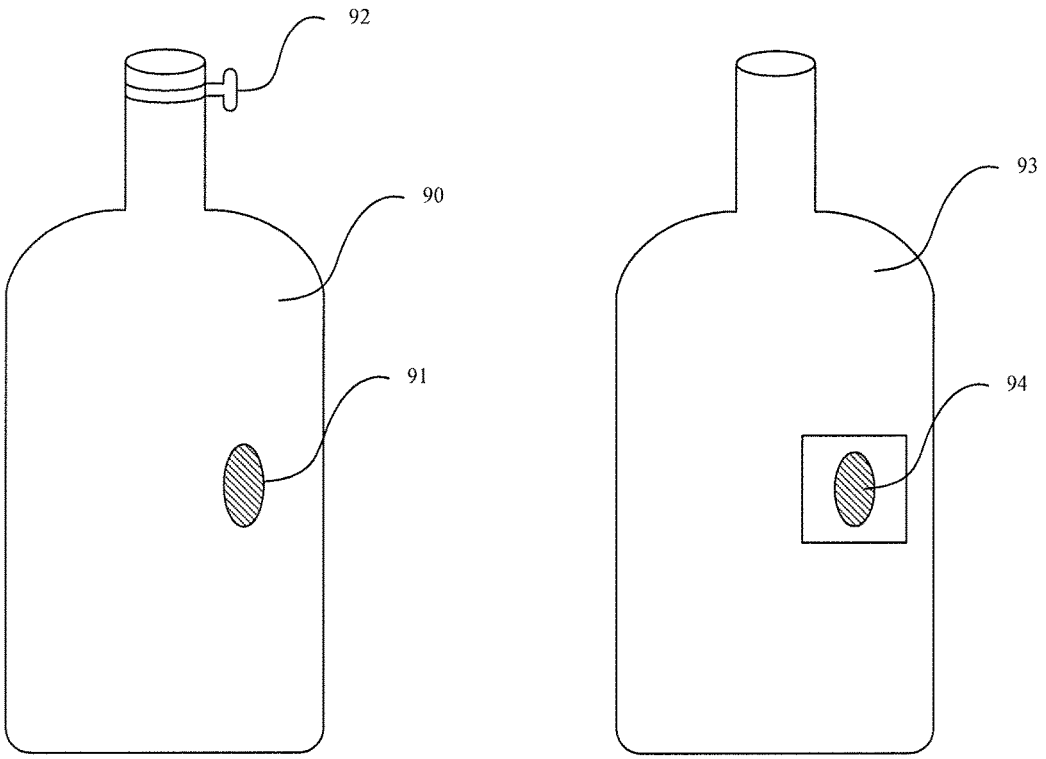
FIG. 9 is an illustration of a container/bottle with a sensor and an interlock device and a container/bottle with a unique identifier.
Figure 10:
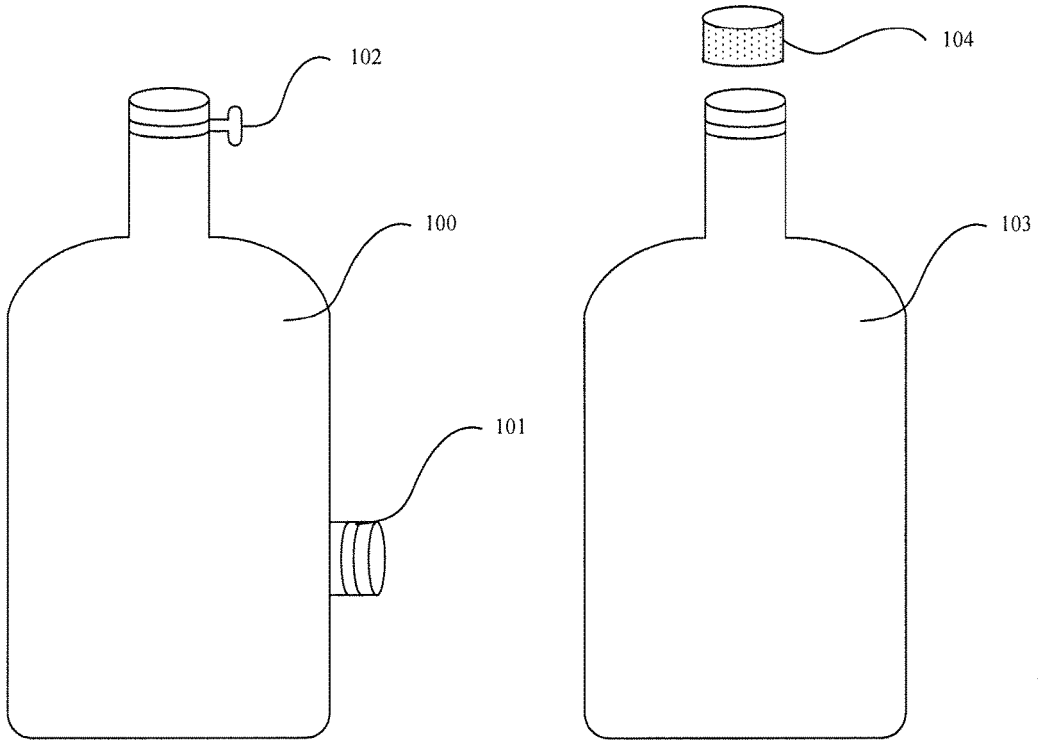
FIG. 10 is an illustration of a bottle with an interlock device and a port for attaching a bottle cap with a unique identifier and a bottle with a cap containing a unique identifier.
Figure 13:
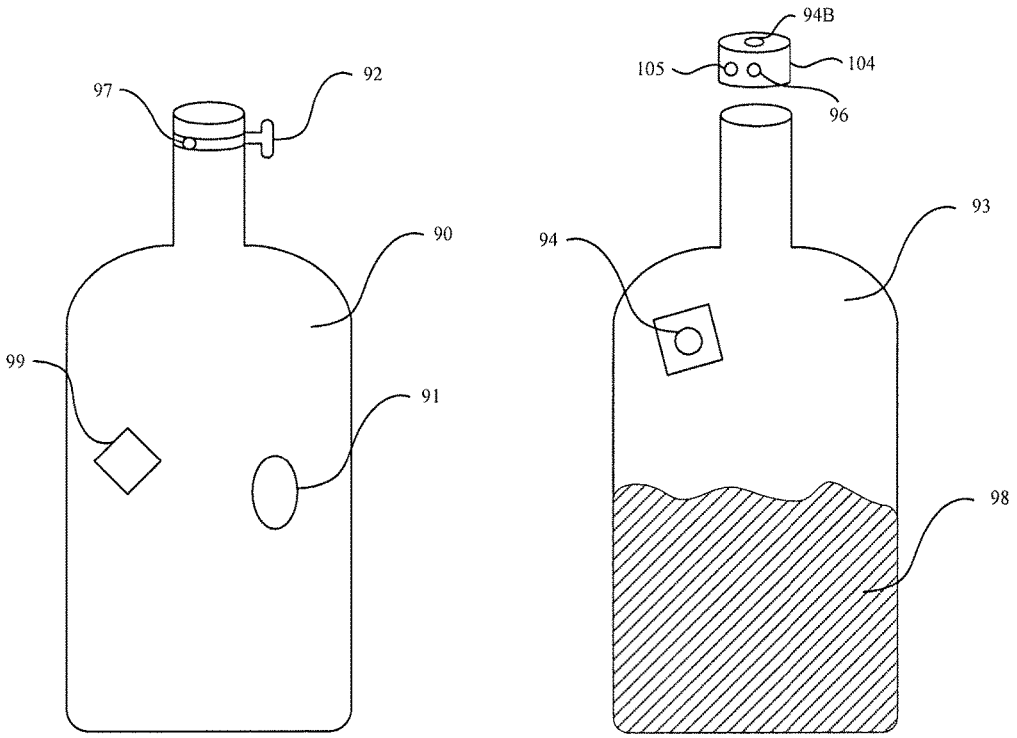
FIG. 13 is an illustration of a container/bottle with a sensor an interlock device, and a timer and a container/bottle with a unique identifier, contents, and a cap with a sensor and timer

In an exemplary aspect of the current invention, the first container may be a bottle, an Example of which is shown in FIG. 9, FIG. 10, and FIG. 13. Although bottles may come in a large variety of shapes and sizes, in general a bottle is a vessel, often of glass and typically cylindrical with a narrow neck that can be closed with a cap or cork, for containing liquids. These liquids may include a beverage, an electrolyte replacement beverage, a medication, a drug, a nutritional supplement, liquid bath soap, hair shampoo, hair conditioner, laundry soap, dishwashing soap, and a number of additional other liquids. In addition to liquids, it can be appreciated that bottles and containers in general also could contain pourable solids such as a powder, pet food, medication, drugs, nutritional supplements, vitamins, candy, gum balls, novelty items, pills, pet litter, flour, sugar, spices, and laundry soap flakes and a myriad of other small items.

It should be appreciated that in some aspects of the invention, the first container of the invention may be a bottle and the second container is a "container". In other aspects, both containers may be bottles as shown in FIG. 9 and FIG. 10. In other aspects, it would be possible for the second container to be a bottle and the first container to be a container.

The containers or bottles of various aspects of the invention may be made of glass; polycarbonate, high density polyethylene, Nalgene, or other plastics; stainless steel, aluminum, or other metals; or other appropriate materials that would prevent the contents from escaping. An exemplary container may be what is commonly referred to as a hydration pack, such as those sold under the trademark Camelbak™. Such hydration packs usually include a flexible bladder that can hold a liquid, and the bladder is often incorporated into a backpack device commonly used by hikers, skiers, and bikers.

Figure 4:
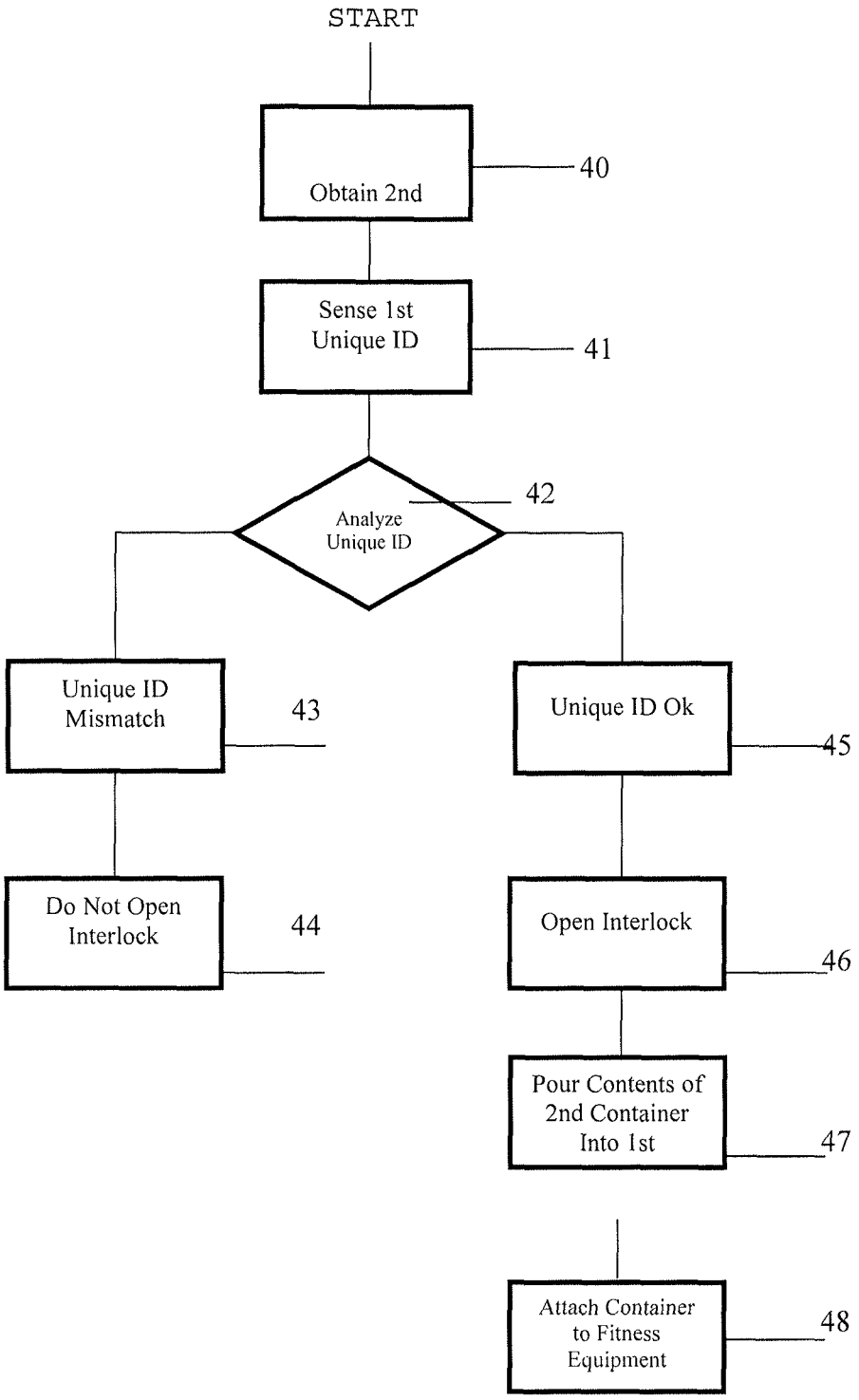
FIG. 4 is an illustration of an aspect of the method of the invention including attaching the container to fitness equipment.

In some aspects of the invention, the first container is a bottle that is attachable to fitness equipment and may be attached to fitness equipment such as a bicycle. An example of this is shown in FIG. 4, where after steps 40-47 are performed similarly to the steps shown in FIG. 1, the container/bottle is attached to fitness equipment in step 48.

Figure 3:
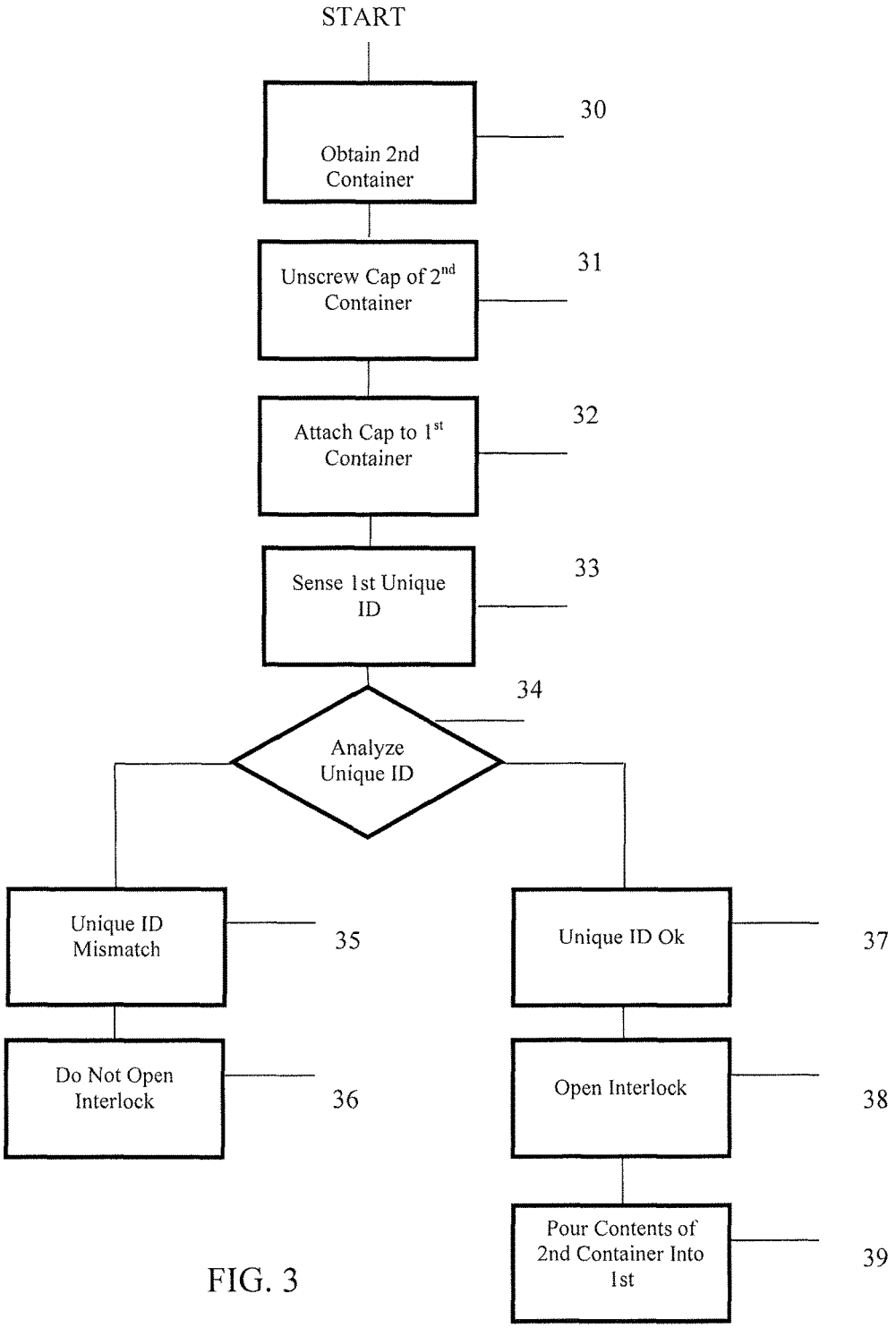
FIG. 3 is an illustration of an aspect of the method of the invention utilizing a unique identifier contained in a cap.

An additional aspect of the invention is shown in the steps illustrated in FIG. 3 and the apparatus of FIG. 10. In this exemplary aspect of the invention, the unique identifier of the second container 103 is located in the cap 104 of the second container 103 or bottle. In step 31, the cap 104 of the second container 103 is unscrewed and removed from the second container 103 and is attached to the sensing port 101 of the first container 100 in step 32. It also could be held in close proximity to the sensor of the first container, even if the first container does not provide a port for reattaching the cap. The unique identifier is analyzed in step 34. If the unique identifier does not match a predetermined set of acceptable values as in step 35 of the flowchart of FIG. 3, an interlock device 102 on the first container 100 remains closed and does not open to allow contents from the second container 103 to be poured into the first container 102. This is shown in step 36 of FIG. 3. If the unique ID does match a predetermined set of acceptable values as in step 37 of FIG. 3, the interlock device 102 of the first container opens as shown in step 38 of FIG. 3 and the contents of the second container 103 may be poured into the first container 100 as shown in step 39 of FIG. 3 and in the apparatus of FIG. 10.

In some aspects of the invention, the step of unscrewing the cap of the second container and attaching the cap to the first container occurs prior to sensing the first unique identifier. In other aspects of the invention, the step occurs after the unique ID was sensed.

Figure 2:
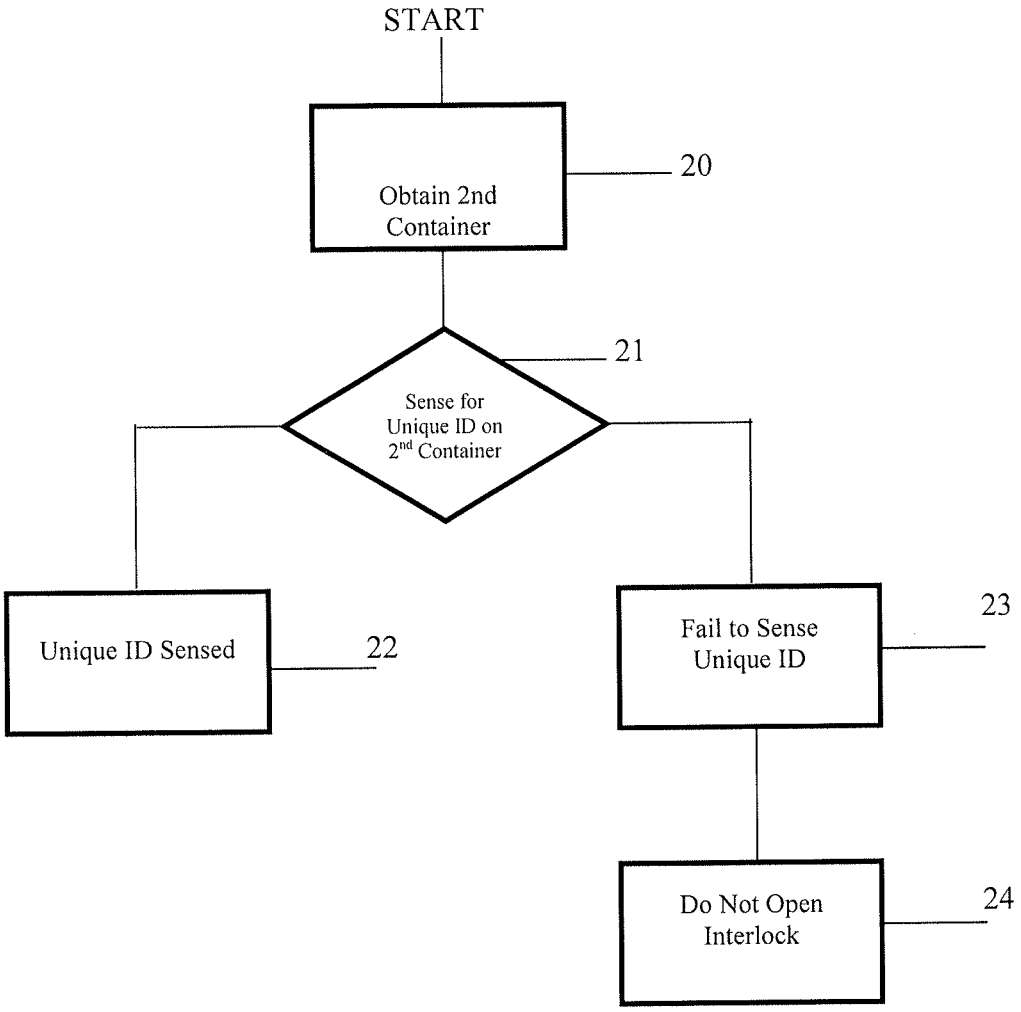
FIG. 2 is an illustration of an aspect of the method of the invention showing a unique identifier being sensed or failing to be sensed.

FIG. 2. illustrates an additional aspect of the method of the invention. Here as in some cases, the second container may not contain a unique identifier to sense or the unique identifier becomes corrupted or lost. In this case, and as shown in steps 20-24 of FIG. 2, if an attempt is made to sense the unique ID as shown in step 21, and nothing is sensed as shown in step 23, then the interlock will not open as shown in step 24. Therefore the interlock prevents the contents from the second container from entering into the first container.

Figure 5:
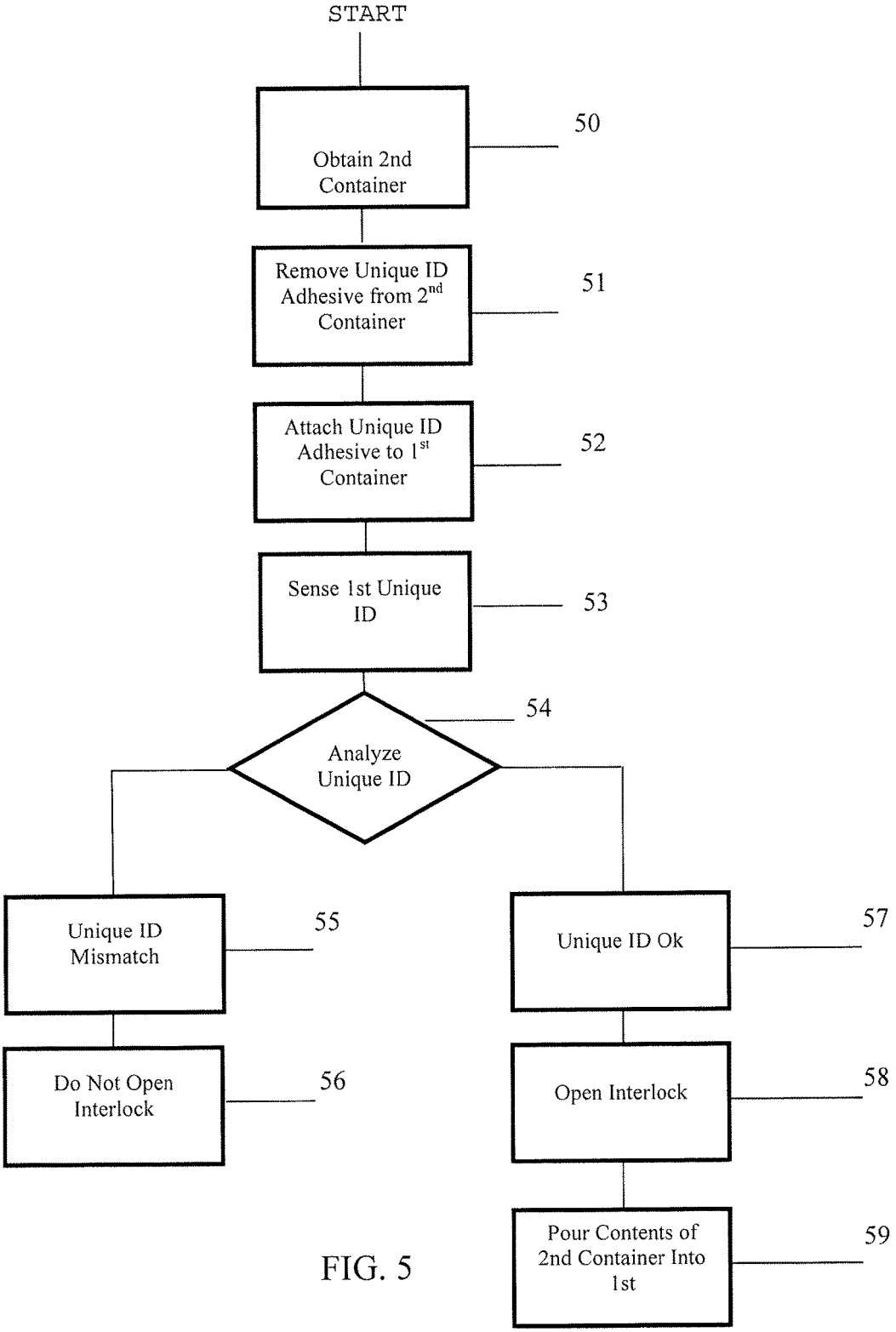
FIG. 5 is an illustration of an aspect of the method of the invention utilizing a unique identifier contained on an adhesive.

Similarly to what was shown in FIG. 3, another exemplary aspect of the invention is shown in FIG. 5. Here, the first unique identifier is attached to the second container with a removable adhesive. In step 51 the first unique identifier is removed from the second container prior to sensing the first unique identifier. In some cases and as shown in step 52 the removable adhesive may be reused to attach the first unique identifier to the first container prior to sensing the first unique identifier. In other cases it may be possible to simply place the removable adhesive in close proximity to the sensor of the first container. The first unique identifier is then sensed as indicated in step 53, and analyzed as in step 54. If the unique identifier is a mismatch as shown in step 55, then the interlock is not opened as shown in step 56. If the unique identifier is a match as shown in step 57, then the interlock is opened as shown in step 58 and the contents of the second container may be poured into the first container as shown in step 59.

An exemplary apparatus of the method described in FIG. 5 and above is shown in FIG. 9. FIG. 9 illustrates a first container 90 or bottle having a sensor 91 and an interlock device 92. FIG. 9 also shows a second container 93 containing a unique identifier 94 which may be removably attached, for example with a reusable adhesive. The unique identifier may also be permanently attached to the second container.

Figure 6:
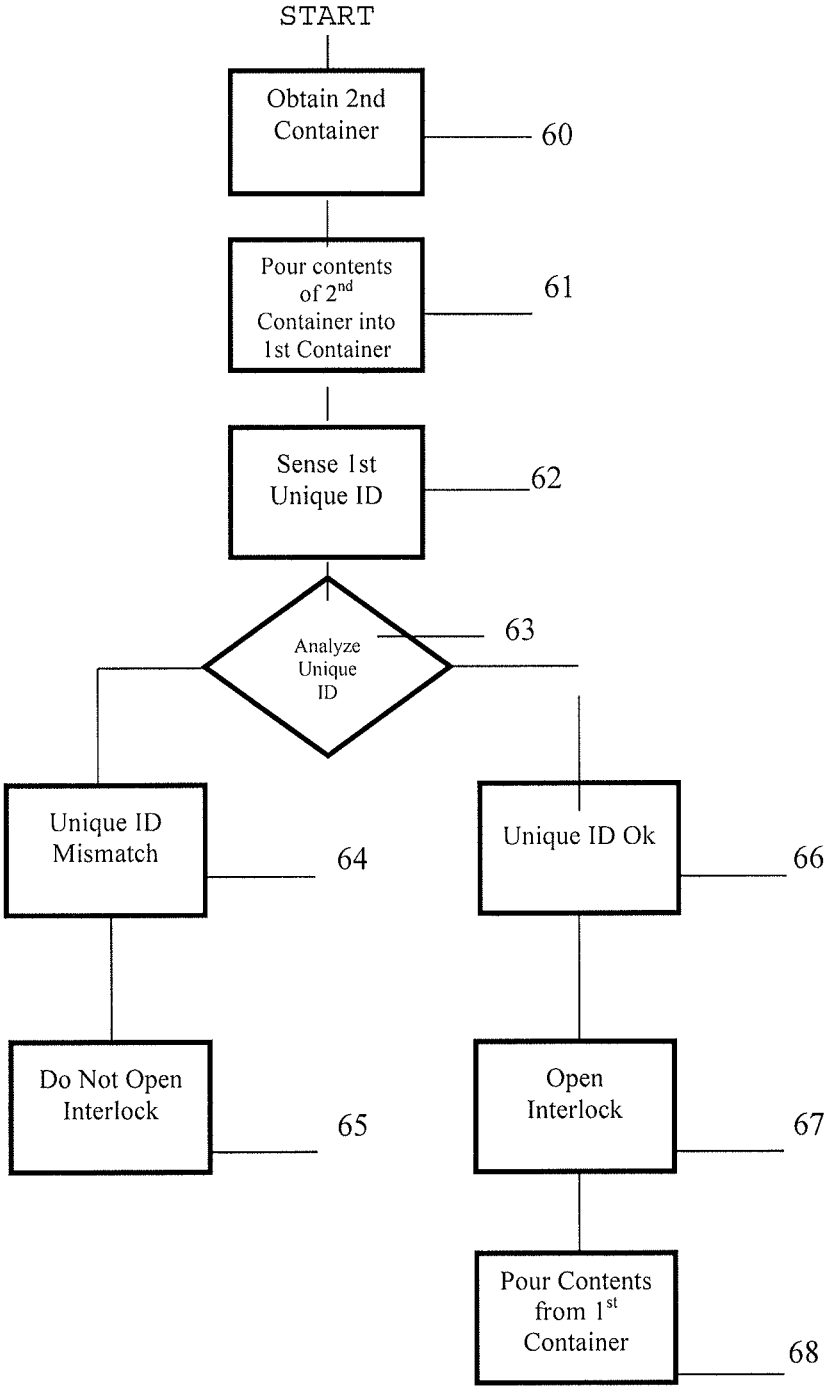
FIG. 6 is an illustration of an aspect of the method of the invention where the contents are placed in the customizable container and the interlock controls whether it may be removed from the container.

Another aspect of the invention is illustrated by the steps shown FIG. 6. The method of this aspect of the invention is for use with a first container. The first container comprises a sensor and an interlock device. In step 60 a second container is obtained. The second container comprises a first unique identifier and has contents. The contents, as described in various forms in other aspects of the invention might be liquid or a pourable solid. The contents of the second container are poured into the first container in step 61. The first unique identifier of the second container is sensed with the sensor of the first container in step 62. In step 63 the first unique identifier of the second container is analyzed. The analysis may compare the unique identifier to a list of acceptable identifiers. The result of the analysis is provided in the form of instruction to the interlock device based on the first result, and the interlock device according to the instruction. If the result of the analysis is a unique identifier mismatch 64, the interlock is not permitted to be opened as shown in step 65. Alternatively, if the result is that the ID is acceptable 66. Then the interlock can be opened as in step 67 and the contents will be permitted to be poured out of the first container 68.

In another aspect of the invention, in addition to the steps shown in FIG. 6, the second container may be a bottle that has an additional specialized function beyond that of a standard bottle. For example, when the contents of the bottle are poured out of the bottle, the bottle may measure how much content passes through the opening. It could also be that the content of the bottle was also measured as it was poured into the bottle from a first container. In this aspect of the invention, it may be that the opening and closing of the interlock does not necessarily relate to whether the liquid or pourable solid is permitted to pass through the opening of the bottle, but could mean in an alternate embodiment that the interlock gives functionality to the device which measures the input and output of the bottle. For example, if the ID is not appropriate, then the measuring device would not provide any information, if the ID is deemed acceptable, the device would measure either how much content goes into the bottle or how much content exits the bottle, or both.

Figure 7:
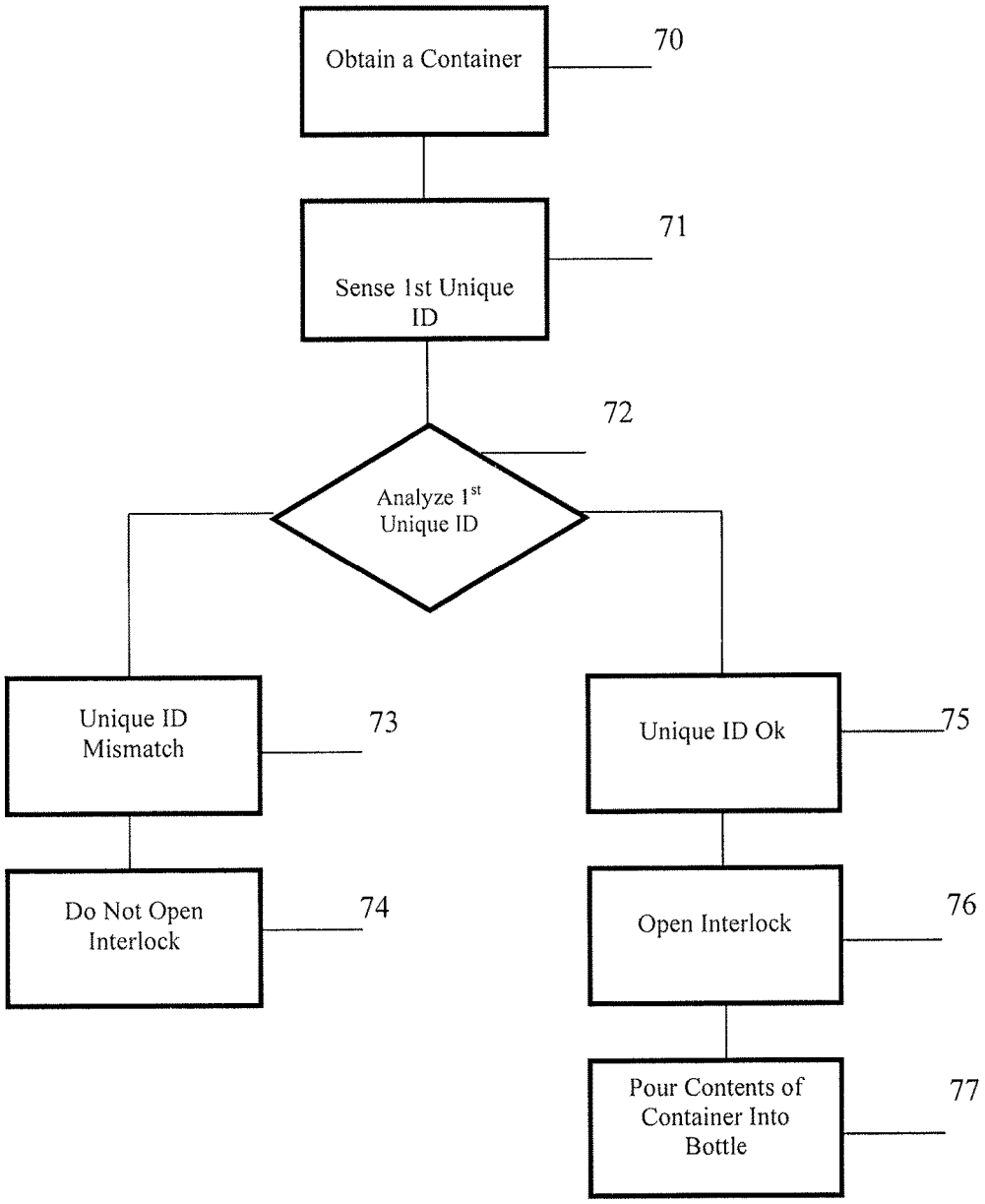
FIG. 7 is an illustration of an aspect of the method of the invention where the customizable container is a bottle.

FIG. 7 illustrates an aspect of the method of the invention which is a method for use with a bottle. The bottle comprises a sensor and an interlock device. In step 70, a container is obtained. The container comprises a first unique identifier and has contents. The contents as described in other aspects of the invention may include various liquids or pourable solids. Step 71 is sensing the first unique identifier of the container with the sensor of the bottle. The first unique identifier of the container is analyzed in step 72 yielding a first result. Based on the first result an instruction is provided to the interlock device. The interlock device is operated according to the instruction. If, as in 73, the unique identifier is considered unacceptable, the interlock does not open as shown in 74. If as in 75, the unique identifier is acceptable, the interlock opens as shown in step 76. A result of the interlock opening or not either permits contents from the container to enter into the bottle or prevents contents from the container from entering into the bottle. Depending on the functionality of the bottle, the interlock may permit or prevent other uses of the bottle as well, in addition to whether or not contents may be added to the bottle.

Figure 8:
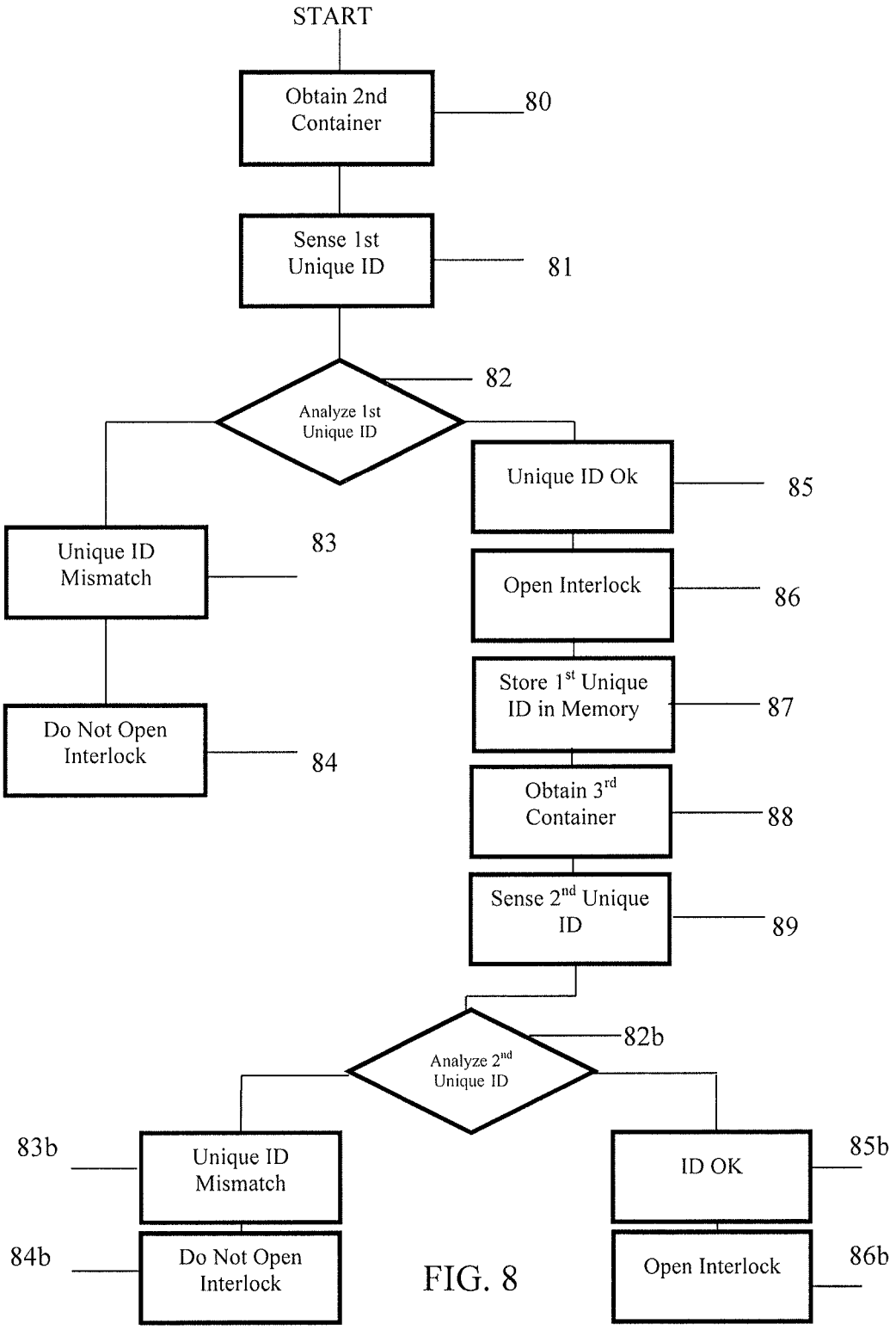
FIG. 8 is an illustration of an aspect of the method of the invention showing a second unique identifier being utilized to operate the interlock device, the second unique identifier while intended to be unique may be rejected because it is the same as the first.

FIG. 8 shows an aspect of the method of the invention for the purpose of preventing the reuse of the unique identifier of a second container to activate the interlock of the first container a second time. In this aspect of the invention, the first container comprises a sensor and an interlock device. Additionally, the first container is communicatively coupled to a writeable memory. In this aspect of the invention, the first container may be a bottle. The method comprises the step 80 of obtaining a second container. The second container comprises a first unique identifier and has contents. The method further comprises the step 81 of sensing the first unique identifier of the second container with the sensor of the first container. The method further comprises the step 82 of analyzing the first unique identifier of the second container and yielding a first result. Based on the first result, the method further comprises the step of providing an instruction to the interlock device. If the unique ID does not match a predetermined set of acceptable values as in step 83 of the flowchart of FIG. 8, an interlock device on the first container remains closed as shown in step 14 of FIG. 8. If the first unique ID does match a predetermined set of acceptable values as in step 85 of FIG. 8, the interlock device of the first container opens as shown in step 86 of FIG. 8. The method shown in FIG. 8 further comprises the step 87 of storing a value relating to the sensed first unique identifier in the writable memory of the first container. In step 88 a third container is obtained. The third container comprises a second unique identifier and has contents. The second unique identifier of the third container is sensed in step 89 with the sensor of the first container. Step 82*b* analyzes the second unique identifier of the third container. This analysis includes comparing the second unique identifier with the stored value of the first unique identifier and yielding a second result. The method of the invention then provides a second instruction to the interlock device based on the second result. If the second unique identifier is not acceptable as shown in step 83*b*, then the interlock does not open as shown in step 84*b*. The contents from the third container would be prevented from entering into the first container. If the second unique identifier is acceptable as shown in step 85*b*, then the interlock is opened as shown in step 86*b*. The open interlock would permit contents from the third container to enter into the first container. If a user attempts to reuse the first unique identifier instead of obtaining a third container with a second unique identifier (or for some reason the first unique identifier has the same value as the second unique identifier) after the interlock of the container has been opened in step 86, then the analysis 82*b* would yield an instruction to the interlock device that the identifier was unacceptable due to it matching the first sensed unique identifier and the interlock would not open.

Another aspect of the invention for preventing multiple uses of the same unique identifier is if the unique identifier comprises properties which modify the unique identifier once the unique identifier is sensed with a first container. For example, the value the unique identifier could be modified is a value that would cause the unique identifier to be deemed unacceptable when analyzed. This would result in an instruction to the interlock device that it should not be opened. It should be appreciated that an alternative aspect of the method of the invention would allow a unique identifier to be used more than once, but could at a specific time be disabled for further use either by configuring the bottle to allow use of a unique identifier for a set number of times or modifying the unique identifier to an unacceptable value after a certain number of uses or times that it is sensed. In yet another aspect of the invention, either the first container or the first unique identifier could be configured with an expiration time and/or date related to a certain time when either the first container or the first unique identifier is modified so that the analysis would yield an instruction to the interlock device preventing it from opening.

Figure 11:
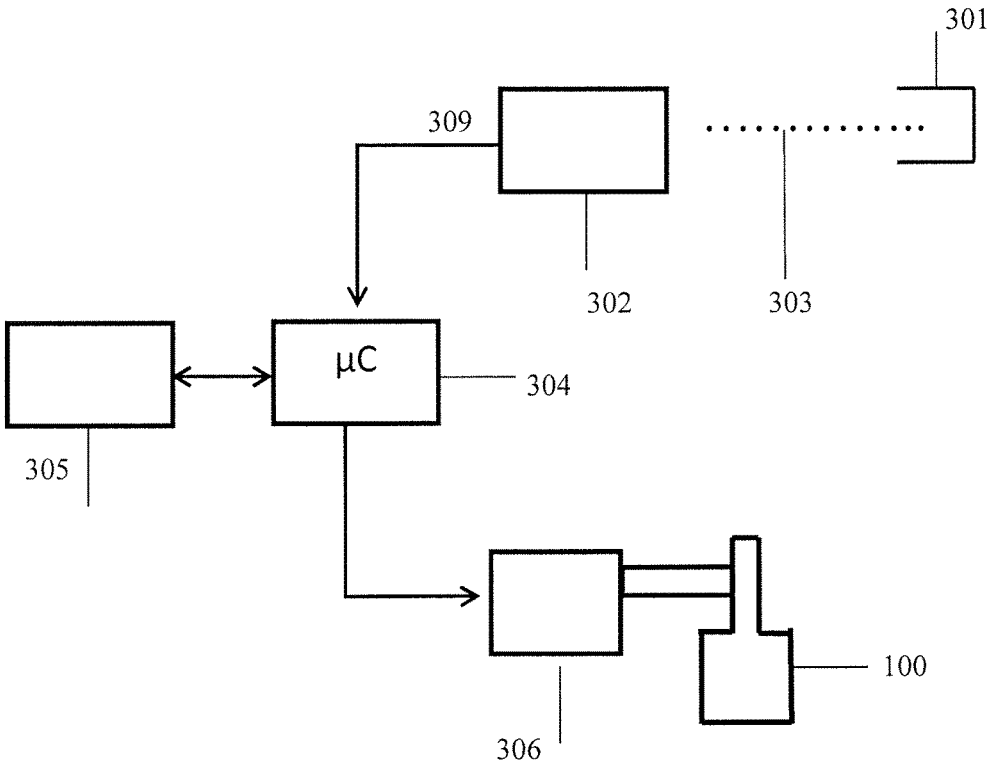
FIG. 11 is a block diagram of an exemplary aspect of the invention.
Figure 12:
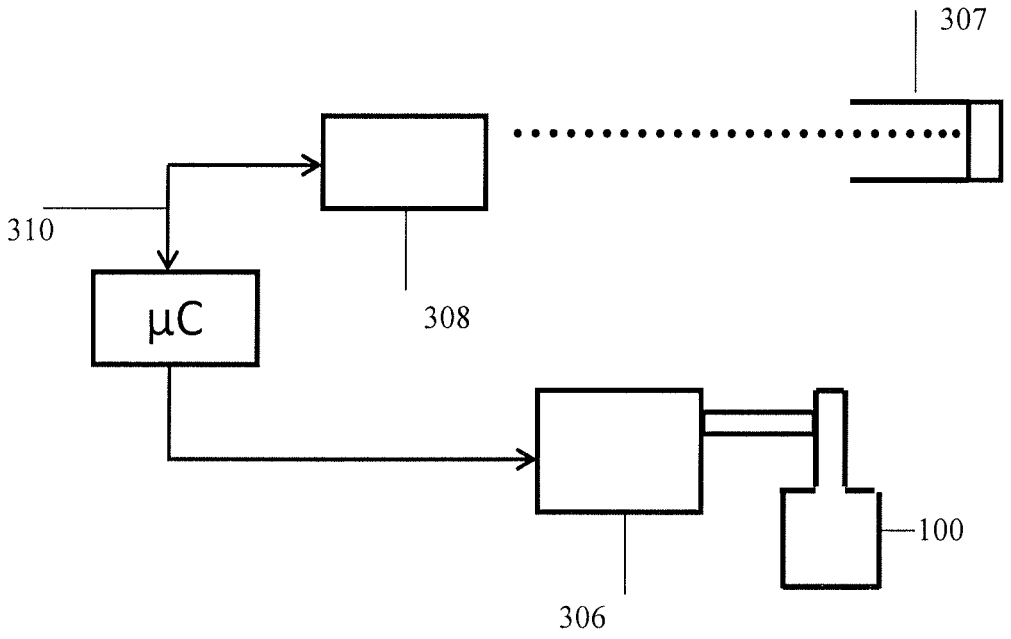
FIG. 12 is a block diagram of an exemplary aspect of the invention.

Turning now to FIGS. 11 and 12, it is instructive to consider particular physical structures which might be employed to bring about the ends set forth above.

In FIG. 11 we see a bottle cap 301 juxtaposed with a sensor 302 by a linkage 303. In an exemplary aspect of invention, the linkage is that the bottle cap 301 bears a bar code or other optically readable code, and the sensor is a bar code reader or other optical code reader. The alert reader will of course appreciate that the linkage could instead, for example, in another aspect of the invention, be an RFID chip in the bottle cap 301 and a near-field communications sensor or other RFID sensor 302. Other linkages 303 could likewise be employed. In this system, the sensor 302 senses some unique identifier and passes it through communications line 309 to microcontroller 304. Microcontroller 304 then consults a memory 305 of unique identifiers which had been consumed in the past. If the current unique identifier does not match any identifier in the memory 305, then this serves as an affirmative finding (see for example box 15 in FIG. 1) and the microcontroller then activates interlock 306 which is connected with a neck or opening of bottle 100.

Memory 305 is, in the simplest case, simply stored within the system as depicted. In an alternative aspect of the invention, the microcontroller 304 could be communicatively coupled with a distant host which in turn maintains the memory 305.

In FIG. 12 we see a bottle cap 307 juxtaposed with an actuator 308. The bottle cap 307 contains some internal state such as a fusible link. In an exemplary aspect of the invention, the state to be stored is that the bottle cap 301 contains a fusible link. The alert reader will of course appreciate that the linkage could instead for example in another aspect of the invention be modeled after well-known antitheft tags which are deactivated by juxtaposition with a strong magnet or are deactivated by a strong RF or magnetic field. Other linkages 303 could likewise be employed. In this system, the sensor 308 not only changes the stored state of the cap 307 but also communicates to microcontroller 304 that it has done so. Microcontroller 304 then activates interlock 306 which is connected with a neck or opening of bottle 100.

Alternatively the juxtaposition of the cap 307 with the actuator 308 fails to bring about a change of the internal state (for example the fusible link has already been blown in the past). This serves as a negative finding (see for example box 23 in FIG. 2) and the interlock 306 is not activated.

One may thus appreciate that some sort of storage of a state is required so as to avoid the unwanted result of a user achieving more activations than were intended to be associated with a particular cap 307. One place to store the state is, as depicted in FIG. 12, in the cap. Another place to store the state is, as depicted in FIG. 11, in a memory 305 that is communicatively coupled with microcontroller 304.

The simple case is the case where the number of activations per cap 307 is one. But it is also possible to permit some other number, for example with a cap 307 which permits two activations but not three.

Aspects of the invention include systems as well as individual components. In one aspect of the invention, as shown in FIG. 9 a first container 90 comprises a sensor 91 communicatively coupled to an interlock device 92. This aspect also includes a second container 93. The second container comprises a first unique identifier 94 which is capable of being sensed by the sensor 91. The second container has contents which may include but is not limited to the various contents described above for other aspects of the invention. The interlock device 92 of the first container is operational based on the first unique identifier 94 of the second container 93. In some aspects of the invention, a cap 104 as shown in FIG. 10 from the second container comprising the first unique identifier 94. An exemplary cap 301 is also shown in FIG. 11 and is further described above. In other aspects of the invention, a removable adhesive comprises the unique identifier. In some aspects of the invention the first container may or may not be a bottle and the second container may or may not be a bottle. As can be appreciated, in various aspects of the invention, it is the interlock device of the first container that is intended to control the transferability of the contents of the second container into the first container, the transferability of the contents of the second container out of the first container, or the transferability of the contents of the second container into and out of the first container.

An aspect of the invention may be directed toward a single container. In this aspect which can be seen in FIG. 9, a container comprises a first sensor 91 communicatively coupled to an interlock device 92. The sensor 91 is capable of sensing a unique identifier from a second container. The interlock device 92 of the container is operational based on the unique identifier of the second container.

Another aspect of the invention may be directed towards a cap such as the one shown in FIG. 13. In one aspect, the cap 104 comprises a unique identifier 94B and is attachable to a container 93 having contents 98. The unique identifier 94B is capable of being sensed by a sensor on a second container and analyzed yielding a result. An interlock device on the second container is operational based the result from the analysis. In other aspects of the invention, the cap 104 may also comprise a biometric or other sensor 105 or a timer 96.

In another aspect of the invention a container 93 comprises first unique identifier 94 and has contents 98. The first unique identifier 94 is capable of being sensed and has a value. Whether an interlock device on a second container 90 is operational depends on the value of the first unique identifier. In another aspect, a container 103 of the invention further comprises a cap 104, the cap comprising the unique identifier 94B.

Additional interlocks, additional sensors and additional controls for a single interlock are beneficial in some aspects of the invention. For example, it may be desirable to incorporate a pressure sensor into an aspect of the invention. The pressure sensor would work in conjunction with the interlock device creating a "child proof" lock which may prevent a child from ingesting potentially dangerous contents from the containers of the invention. In this aspect of the invention a bottle or container comprising a pressure sensor communicatively coupled with interlock device would only allow operation of the interlock under certain pressure, for example a level of pressure that a child would be unlikely to be able to apply. The pressure sensor may be located, for example, in a cap, the interlock device, or as a separate stand-alone sensor. An interlock on a container generally may become operational if adequate pressure is applied to a sensor, another recognized unique identifier is sensed, or a combination of the two. An exemplary aspect of the invention involving a pressure sensor, referred to more broadly as a "biometric sensor" or "biometric reader" follows.

Figure 14:
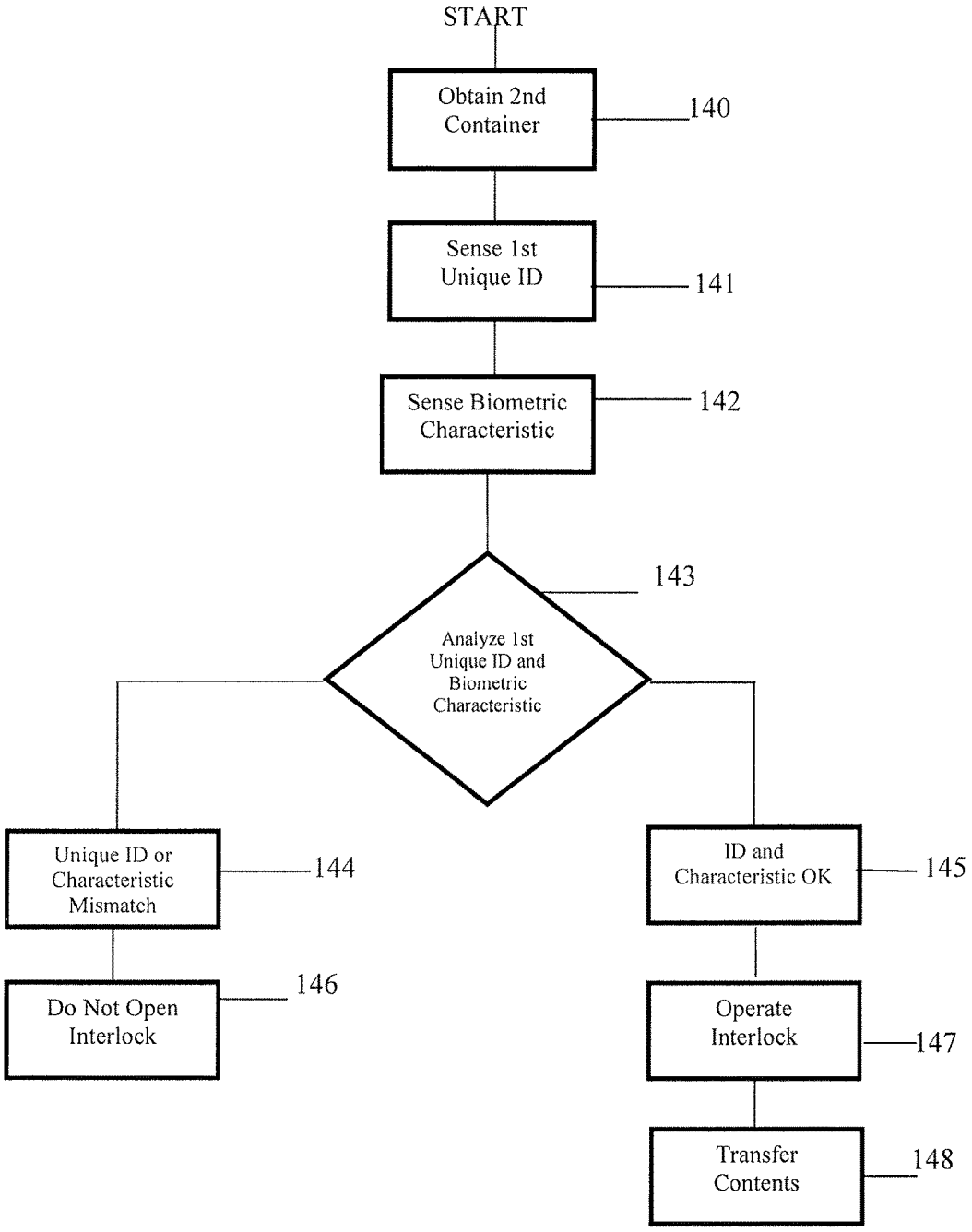
FIG. 14 is an illustration of an aspect of the method of the invention showing a biometric characteristic being sensed and analyzed prior to the operation of an interlock.

In this aspect of a method of the invention, illustrated in FIG. 13, a first container 90 comprises a first sensor 91, a second sensor 99, and an interlock device 92. The second sensor 99 is a biometric sensor. Exemplary biometric sensors include but are not limited to those which sense pressure, finger prints, eye characteristics, and other Physiological and Behavioral characteristics. This exemplary aspect of the method of the invention includes the following steps which are shown in FIG. 14. Obtain a second container 140. As with other aspects of the invention, the second container comprises a first unique identifier and has a contents. Sense the first unique identifier of the second container with the first sensor of the first container 141. Analyze the first unique identifier of the second container, yielding a first result 143. Sense a biometric characteristic with the second sensor 142. Analyze the biometric characteristic and yield a second result 143. Provide an instruction to the interlock device based on the first and second results 144 and 145. Operate the interlock device in a manner of operation according to the instruction 146 and 147. This exemplary method of the invention may further comprise the step of pouring the contents of the second container into the first container 148. The manner of operation may permit the contents from the second container to exit the first container. As mentioned previously, the second sensor could be a pressure sensor and the biometric characteristic sensed and analyzed may be the amount of pressure applied to the biometric sensor.

A system complementary to the method of the invention described above is shown at least in FIG. 13 and comprises a first container 90 with a first sensor 91, a second sensor 99, and an interlock device 92 communicatively coupled to the first and second sensors. In this aspect of the invention, the second sensor 99 is a biometric sensor. The system further may comprise a second container 93 comprising a first unique identifier 94 capable of being sensed by the first sensor 91 and having contents 98. The interlock device 92 is operational at least based on the first unique identifier 94. In this aspect of the invention, it may also be based on what is sensed with the biometric sensor 99. It should be appreciated that the second container 93 may further comprise a cap 104 which comprises an alternate first unique identifier 94B.

An alternative version of the system above, also shown in FIG. 13, would be to put an alternative biometric or other type of sensor 105 in the cap from the second container. This aspect of the invention comprises a first container 90 comprising a first sensor 91 and an interlock device 92. It further comprises a second container 93 comprising a first unique identifier 94 capable of being sensed by the first sensor 91. The second container 93 further comprises a cap 104 which has a second sensor 105 and contents 98. In this aspect of the invention, the interlock device 92 is communicatively coupled to the first 91 and second sensors 105. As previously mentioned, the second sensor 105 may be a biometric sensor. The interlock device 92 is operational based on the first unique identifier 94 and information obtained by the biometric sensor 105 or other type of sensor. As can be appreciated, the biometric sensor 105 can be a pressure sensor and may or may not be programmable. The cap 104 in this aspect of the invention may also comprise the unique identifier 94B.

It may be desirable to limit the consumption of the contents of a bottle 91 to certain periods of time. An example would be if the bottle contained medication that would harm the user if too much was taken at once. It could be the case that the interlock allowed only a certain volume to exit and then would only allow further volume to exit after a specific amount of time passed. It could also be the case that the user was in control of how much liquid was removed at a given time, but that a certain amount of time would need to pass before additional liquid could be removed. This feature may be particularly helpful to users that are very forgetful, perhaps because they are suffering from Alzheimer's disease.

Figure 15:
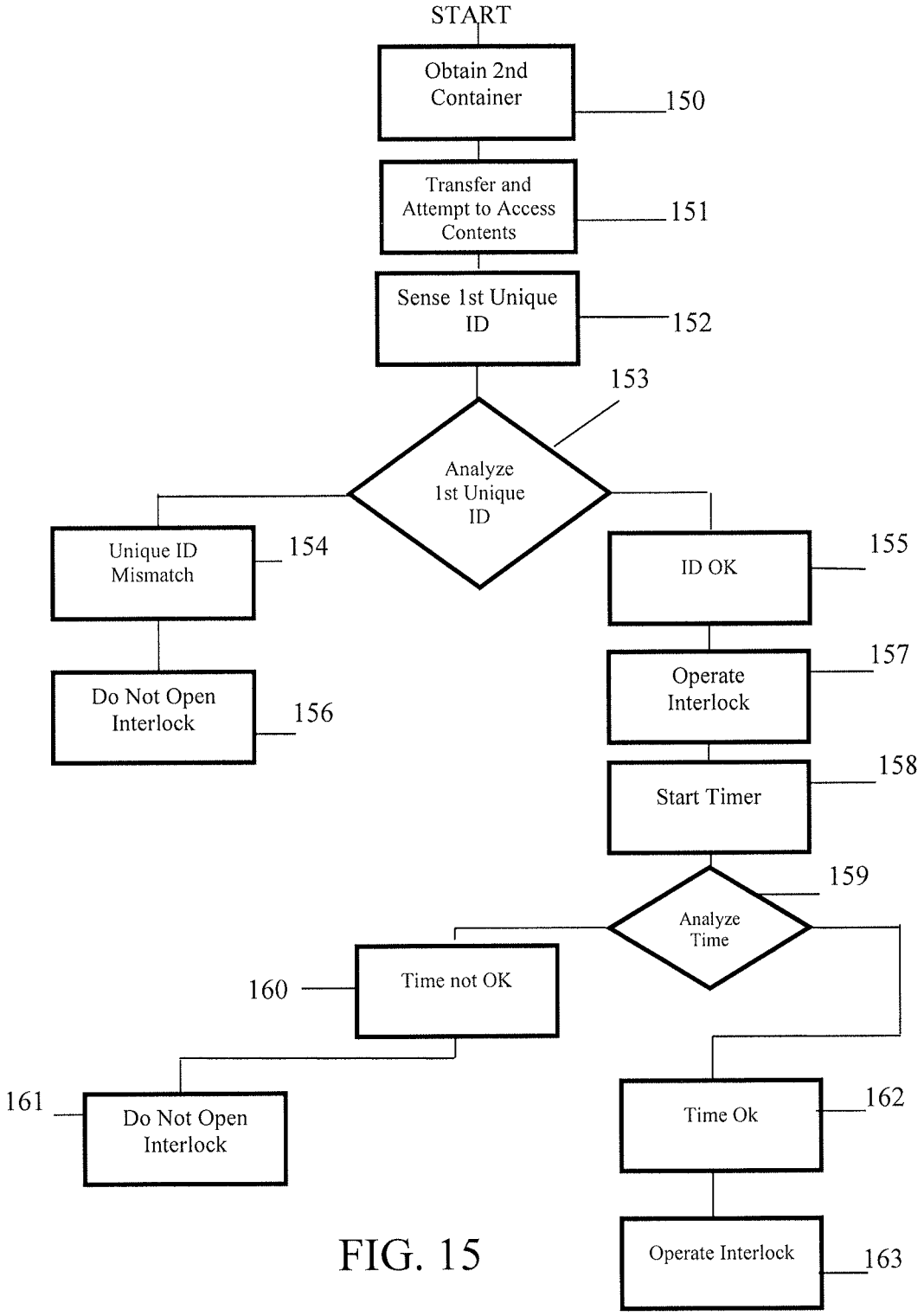
FIG. 15. is an illustration of an aspect of the method of the invention showing a timer being used its result being analyzed prior to the operation of an interlock.

An aspect of the invention controlling the interlock of a bottle with a timer is illustrated in FIG. 15. It is a method for use with a first container comprising a first sensor and a timer communicatively coupled to an interlock device. The timer may or may not be programmable. The method comprises the following steps. Obtain a second container comprising a first unique identifier and having contents 150. Pour at least some of the contents of the second container into the first container 151. Sense the first unique identifier with the sensor 152. Analyze the first unique identifier and determine a first result 153. Provide a first instruction to the interlock device based on the first result 154 and 155. Operate the interlock device according to the first instruction 156 and 157. If the first operation of the interlock device permits contents from the second container to exit the first container a timer will either automatically start after at least some of the contents exits the first container, or the timer should be manually started 150. Allow time to pass. Determine how much time passed since the first operation of the interlock device with the timer 159. This determination yields a second result. Provide a second instruction to the interlock device based on the second result 160 and 162. Operate the interlock device according to the second instruction 161 and 163. In one aspect of the invention, as shown in FIG. 13, the interlock device comprises the timer 97. Alternatively, the second container could further comprise a cap and the cap comprises the first unique identifier. The cap may also alternatively comprise the timer. In another aspect of the invention, the system may also utilize the timer to control how long the interlock remained open before it closed again.

Another aspect of the invention illustrated in FIG. 13 comprises a first container 90 comprising a sensor 91 communicatively coupled to an interlock device 92, and a memory such as memory 305 shown in FIG. 11. This aspect of the invention further comprises a second container 93 comprising a first unique identifier 94 capable of being sensed by the sensor 91. The second container has contents 98. This aspect of the invention further comprises a third container (not shown but similar to second container 98) having a second unique identifier capable of being sensed by the sensor, and also has a contents. The interlock device 92 of the first container 90 is initially operational based on the first unique identifier 94. Then, if a user decides to attempt to use the first container 90 at least a second time with, for example, a third container, it is operational based on an outcome of an analysis of whether the first unique identifier and second unique identifiers are non-identical.

The alert reader will readily appreciate that while the invention is disclosed with respect to the structure set forth above, one could readily substitute many obvious variants and improvements without deviating in any way from the teachings of the invention. Thus for example while a microcontroller is depicted, it would be possible to use a microprocessor with associated circuitry and devices. Likewise one could use application-specific integrated circuits or field-programmable gate arrays, or even random logic, to accomplish the ends set forth above.

In other exemplary aspects of the invention, the container may be something other than a bottle. As described above, exemplary containers may include bottles, sealable bags, hydration packs, sealable boxes, and other containers of various shapes and sizes. In addition, and as described in exemplary aspects above, cap 307 as illustrated in FIG. 11 and FIG. 12 could be interchanged with a removable adhesive, or could be something permanently affixed to a second container.

While a number of exemplary aspects of the invention have been discussed above, the alert reader will recognize certain modifications, permutations, additions and subcombinations therefore. Each apparatus aspect described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred aspects and optional features, modification and variation of the concepts herein disclosed may be resorted to by the alert reader, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and known contexts. The above definitions are provided to clarify their specific use in the context of the invention.

What is claimed:

1. A first container, comprising:

an interlock device configured to control transferability of content through a first opening defined by the first container;

a sensor configured to sense a first unique identifier (UID) value from a second container, the second container having contents transferrable through the first opening of the first container;

a memory storing a plurality of UID values acceptable to the first container; and a controller configured to:

receive the first UID value from the sensor;

determine whether the first UID value matches one of the plurality of acceptable UID values stored in the memory; and instruct the interlock device to transfer the contents through the first opening of the first container based on a match between the first UID value and an acceptable UID value.

2. The first container of claim 1, wherein the sensor is configured to sense the first UID value from a cap of the second container.

3. The first container of claim 1, wherein the first container is a bottle.

4. The first container of claim 1, wherein the sensor is configured to sense the first UID value from a removable adhesive of the second container.

5. The first container of claim 1, wherein the controller is further configured to:

instruct the interlock device to prevent the transfer of the contents through the first opening of the first container based on a mismatch between the first UID value and an acceptable UID value.

6. The first container of claim 1, wherein the transfer of the contents through the first opening comprises at least one of:

fill the first container with the contents from the second container; or dispense the contents from the first container.

7. The first container of claim 1, wherein the contents comprise a liquid or a pourable solid.

8. The first container of claim 1, wherein the sensor is an optical code reader and the first UID value is an optically readable code.

9. The first container of claim 1, wherein the sensor is an RFID reader and the first UID value is a RFID chip identifier.

10. A first container, comprising:

an interlock device connected to a first opening defined in the first container, wherein the interlock device is configured to control transferability of content through the first opening;

a sensor configured to sense a first unique identifier (UID) value from a second container, the second container having contents transferrable through the first opening of the first container;

a memory storing at least one set of UID values including a first set of UID values comprising a plurality of UID values acceptable to the first container; and a controller configured to:

receive the first UID value from the sensor;

determine whether the first UID value matches one of the acceptable UID values of the first set of UID values;

provide an instruction to the interlock device associated with a transfer of the contents through the first opening of the first container; and store the first UID value in the memory.

11. The first container of claim 10, wherein the at least one set of UID values further comprises a second set of UID values comprising a plurality of UID values previously sensed by the sensor, and wherein the controller is configured to store the first UID value in the memory as one of the second set of UID values.

12. The first container of claim 11, wherein the controller is further configured to:

determine whether the first UID value matches one of the previously sensed UID values of the second set of UID values based on a match between the first UID value and an acceptable UID value of the first set of UID values;

wherein, providing the instruction comprises transmitting an instruction to permit the transfer of the contents through the first opening of the first container based on a mismatch between the first UID value and a previously sensed UID value of the second set of UID values; and wherein, providing the instruction comprises transmitting an instruction to prevent the transfer of the contents through the first opening of the first container based on a match between the first UID value and a previously sensed UID value of the second set of UID values.

13. The first container of claim 12, wherein the first UID value is associated with a limit comprising a use limit, a time limit, or a combination thereof.

14. The first container of claim 13, wherein the controller is further configured to:

determine that the limit associated with the first UID value has not been met.

15. The first container of claim 10, wherein the sensor is positioned to sense the first UID value from a cap of the second container.

16. The first container of claim 15, further comprising:

a sensing port configured to receive the cap of the second container to sense the first UID value.

17. The first container of claim 10, wherein the transfer of the contents through the first opening comprises at least one of:

the contents from the second container entering the first container; or the contents exiting the first container.

18. A second container, comprising:

a first unique identifier (UID) value; and contents, wherein said contents are transferrable from said second container through a first opening defined by a first container;

wherein the first UID value is configured to be:

sensed by a sensor of the first container;

received by a controller of the first container; and compared by the controller to a plurality of acceptable UID values stored in a memory of the first container to activate an interlock device of the first container to allow a transfer of the contents of the second container through the first opening based on a match between the first UID value and an acceptable UID value.

19. The second container of claim 18, further comprising at least one of:

a cap comprising the first UID value; or a removable adhesive comprising the first UID value.

20. The second container of claim 18, wherein the first UID value is associated with a limit comprising a use limit, a time limit, or a combination thereof.

* * * * *